US012703932B2

(12) United States Patent
Fujisawa et al.

(10) Patent No.: US 12,703,932 B2
(45) **Date of Patent: *Aug. 11, 2026**

(54) INDUSTRIAL FABRIC

(71) Applicant: NIPPON FILCON CO., LTD., Tokyo (JP)

(72) Inventors: Shigenobu Fujisawa, Shizuoka (JP); Yusuke Nomura, Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 19/192,227

(22) Filed: Apr. 28, 2025

(65) Prior Publication Data

US 2025/0257503 A1 Aug. 14, 2025

Related U.S. Application Data

(63) Continuation of application No. 18/399,620, filed on Dec. 28, 2023, now Pat. No. 12,312,716, which is a (Continued)

(30) Foreign Application Priority Data

Jul. 2, 2021 (JP) ..... 2021-110973

(51) Int. Cl.
*D03D 13/00* (2006.01)
*D21F 7/08* (2006.01)

(52) U.S. Cl.
CPC ..... *D03D 13/004* (2013.01); *D10B 2403/011* (2013.01)

(58) Field of Classification Search
CPC ..... D03D 13/004; D10B 2403/011; D21F 1/0045
See application file for complete search history.

(56) References Cited

U.S. PATENT DOCUMENTS 7,270,151 B2 * 9/2007 Nagura ..... D21F 1/0036 162/902
7,343,938 B2 * 3/2008 Takimoto ..... D21F 1/0036 139/383 A (Continued)

FOREIGN PATENT DOCUMENTS

CN 1707023 A 12/2005
CN 112041501 A 12/2020

(Continued)

OTHER PUBLICATIONS

Office Action issued in Chinese Application No. 202280039608.8, dated Jul. 18, 2025.

(Continued)

*Primary Examiner* — Robert H Muromoto, Jr.
(74) *Attorney, Agent, or Firm* — Michael Best & Friedrich LLP

(57) ABSTRACT

Binding warps have first and second binding warps arranged vertically in a pair and a third binding warp forming knuckles passing above upper surface side wefts. Upper surface side warps include an upper surface side collapsing yarn forming a pair with the third binding warp. The upper surface side collapsing yarn passes below the wefts and collapses a part of the upper surface side obverse surface texture at a position where the third binding warp forms knuckles on the wefts. The pair formed by the first and second binding warps complement each other while the pair formed by the third binding warp and the upper surface side collapsing yarn complement each other in a weave repeat.

9 Claims, 21 Drawing Sheets

Related U.S. Application Data continuation of application No. PCT/JP2022/011458, filed on Mar. 15, 2022.

(56) References Cited

U.S. PATENT DOCUMENTS

| | | | | |
|---|---|---|---|---|
| 7,357,156 | B2 * | 4/2008 | Ueda | D21F 1/0036 162/902 |
| 7,426,943 | B2 * | 9/2008 | Ueda | D21F 1/0036 139/408 |
| 12,312,716 | B2 * | 5/2025 | Fujisawa | D21F 1/0045 |
| 2005/0268981 | A1 | 12/2005 | Barratte | |
| 2006/0102244 | A1 * | 5/2006 | Ueda | D21F 1/0036 139/383 A |
| 2006/0112999 | A1 * | 6/2006 | Nagura | D21F 1/0036 139/383 A |
| 2007/0095417 | A1 * | 5/2007 | Fujisawa | D21F 1/0036 139/383 A |
| 2015/0013821 | A1 * | 1/2015 | Ueda | D03D 11/00 139/409 |
| 2016/0369432 | A1 * | 12/2016 | Egawa | D03D 11/00 |
| 2019/0040555 | A1 | 2/2019 | Ueda | |
| 2019/0136422 | A1 * | 5/2019 | Egawa | B01D 39/083 |

FOREIGN PATENT DOCUMENTS

| | | | |
|---|---|---|---|
| CN | 112513354 | A | 3/2021 |
| JP | 2001-159086 | A | 6/2001 |
| JP | 2003-342889 | A | 12/2003 |
| JP | 2010-126862 | A | 8/2005 |
| JP | 2006-152462 | A | 6/2006 |
| JP | 2006-328585 | A | 12/2006 |
| JP | 2008-057052 | A | 3/2008 |
| JP | 2008-138308 | A | 6/2008 |
| WO | 2017/126234 | A1 | 7/2017 |

OTHER PUBLICATIONS

Extended Search Report issued in European Application No. 22832474.5, mailed Aug. 12, 2024.

International Search Report issued in Application No. PCT/JP2022/011458, mailed May 24, 2022.

International Preliminary Report on Patentability issued in PCT Appplication No. PCT/JP2022/011458, issued Dec. 14, 2023.

Office Action issued in Canadian Application No. 3,224,260, dated Jan. 26, 2026.

Article 94(3) EPC Communication issued in European Application No. 22832474.5-1015, dated Dec. 23, 2025.

* cited by examiner

FIG. 18

| | | 1Bs | 2L | 3Bt | 4L | 5Bs | 6L | 7Bt | 8L | 9Bs | 10L | 11Bt | 12L | 13Bs | 14L | 15Bt | 16L |
|---|---|---|---|---|---|---|---|---|---|---|---|---|---|---|---|---|---|
| 24'U | | | | | | | | ▲ | | | | | | | | | |
| 23'U | 23'L | ⊗ | | | | ▲ | | | ○ | △▲ | | | | | | | ○ |
| 22'U | 22'L | | | | | △ | ○ | ▲ | | | | | | ○ | ○ | | |
| 21'U | | | | | | ▲ | | | | ▲ | | | | | | | |
| 20'U | 20'L | | ○ | ⊗ | | | | | | | ○ | ⊗ | | | | | |
| 19'U | 19'L | ▲ | | | | ▲ | | ○ | ○ | | | | | | | ○ | ○ |
| 18'U | | | | ▲ | | | | | | | | | | | | | |
| 17'U | 17'L | ▲ | | | ○ | △▲ | | | | | | | ○ | ⊗ | | | |
| 16'U | 16'L | △ | ○ | ▲ | | | | | | ○ | ○ | | | | | | |
| 15'U | | ▲ | | | | ▲ | | | | | | | | | | | |
| 14'U | 14'L | | | | | | ○ | ⊗ | | | | | | | ○ | ⊗ | |
| 13'U | 13'L | ▲ | | ○ | ○ | | | | | | | ○ | ○ | ▲ | | | |
| 12'U | | | | | | | | | | | | | | | | ▲ | |
| 11'U | 11'L | △▲ | | | | | | | ○ | ⊗ | | | | ▲ | | | ○ |
| 10'U | 10'L | | | | | ○ | ○ | | | | | | | △ | ○ | ▲ | |
| 9'U | | ▲ | | | | | | | | | | | | ▲ | | | |
| 8'U | 8'L | | ○ | ⊗ | | | | | | | ○ | ⊗ | | | | | |
| 7'U | 7'L | | | | | | | ○ | ○ | ▲ | | | | ▲ | | ○ | ○ |
| 6'U | | | | | | | | | | | | ▲ | | | | | |
| 5'U | 5'L | | | | ○ | ⊗ | | | | ▲ | | | ○ | △▲ | | | |
| 4'U | 4'L | ○ | ○ | | | | | | | △ | ○ | ▲ | | | | | |
| 3'U | | | | | | | | | | ▲ | | | | ▲ | | | |
| 2'U | 2'L | | | | | | ○ | ⊗ | | | | | | | ○ | ⊗ | |
| 1'U | 1'L | | | ○ | ○ | ▲ | | | | ▲ | | ○ | ○ | | | | |
| | | 1Bf | | 3U | | 5Bf | | 7U | | 9Bf | | 11U | | 13Bf | | 15U | |

140

INDUSTRIAL FABRIC

CROSS-REFERENCE TO RELATED APPLICATION

This application claims the benefit of, and priority to, U.S. application Ser. No. 18/399,620, filed on Dec. 28, 2023, which is a continuation of International Application No. PCT/JP2022/011458, filed on Mar. 15, 2022, which claims priority to Japanese Patent Application No. 2021-110973, filed on Jul. 2, 2021, the entire contents of which are incorporated by reference herein in their entirety.

1. FIELD OF THE INVENTION

The present invention relates to industrial fabrics used for paper machines.

2. DESCRIPTION OF THE RELATED ART

In the related art, papermaking meshes made of warps and wefts have been widely used as industrial fabrics for paper machines. The characteristics required for the papermaking meshes vary. For example, Patent Literature 1 discloses an industrial fabric that includes: an upper layer surface side fabric including upper layer surface side warps and upper layer surface side wefts; a lower layer surface side fabric including lower layer surface side warps and lower layer surface side wefts; upper layer surface side warps functioning as binding yarns; and lower layer surface side warps functioning as binding yarns. The upper layer surface side warps functioning as binding yarns and the lower layer surface side warps functioning as binding yarns are provided in pairs at the top and bottom.

PATENT LITERATURE 1: JP 2003-342889

While having high strength for binding an upper surface side fabric and a lower surface side fabric, upper layer surface side warps serving as binding yarns and lower layer surface side warps serving as binding yarns paired at the top and bottom become a factor that reduces the surface properties of the upper surface side fabric. Therefore, as the number of pairs of upper surface side warps serving as binding yarns and lower surface side warps serving as binding yarns increases in an attempt to improve the binding strength, the surface properties of the upper surface side fabric decrease.

SUMMARY OF THE INVENTION

A purpose of the present invention is to provide industrial fabrics that improve the surface properties of an upper surface side fabric while ensuring binding strength.

Solution to Problem

An embodiment of the present invention relates to an industrial fabric in which an upper surface side fabric and a lower surface side fabric are bound, including: upper surface side wefts that form a portion of the upper surface side fabric; lower surface side wefts that form a portion of the lower surface side fabric; upper surface side warps that are interwoven only with the upper surface side wefts so as to form a portion of the upper surface side fabric; lower surface side warps that are interwoven only with the lower surface side wefts so as to form a portion of the lower surface side fabric; and binding warps that bind the upper surface side fabric and the lower surface side fabric. Binding warps have a first binding warp and a second binding warp that are arranged vertically in a pair and a third binding warp that forms knuckles passing above upper surface side wefts. Upper surface side warps include an upper surface side collapsing yarn that forms a pair with the third binding warp. The upper surface side collapsing yarn passes below the upper surface side wefts and collapses a part of the upper surface side obverse surface texture at a position where the third binding warp forms the knuckles on the upper surface wefts. The pair formed by the first binding warp and the second binding warp complement each other while the pair formed by the third binding warp and the upper surface side collapsing yarn complement each other in a weave repeat.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 18 is a design diagram showing a weave repeat of an industrial fabric according to the twelfth embodiment;

DETAILED DESCRIPTION OF THE INVENTION

The invention will now be described by reference to the preferred embodiments. This does not intend to limit the scope of the present invention, but to exemplify the invention.

In the following explanation, "warps" are threads extending along the direction of web conveyance, and "wefts" are threads extending in a direction that intersects the warps, when a multi-layered fabric for papermaking constitutes a looped belt. The "upper surface side fabric" is a fabric located on the obverse surface side where the web is conveyed out of the two sides of a papermaking mesh when a multi-layered fabric is used as the papermaking mesh, and the "lower surface side fabric" is a fabric located mainly on the reverse surface side where a drive roller is in contact out of the two sides of a papermaking belt. The "obverse surface" simply means a surface on the side where the upper surface side fabric or the lower surface side fabric is exposed. While the "obverse surface" of the upper surface side fabric corresponds to the obverse surface side of a papermaking mesh, the "obverse surface" of the lower surface side fabric corresponds to the reverse surface side of the papermaking mesh.

Further, the term "design diagram" represents the minimum repeating unit of a textile texture and corresponds to a weave repeat of the textile. In other words, the term "weave repeat" is repeated from front to back and left to right to form a "textile". Further, "knuckle" refers to a part where a warp is exposed on the obverse surface after passing over or under a single or multiple wefts.

Further, "binding warps" means at least some of warps that make up the upper surface side fabric (or lower surface side fabric) and are yarns that bind the upper surface side fabric with the lower surface side fabric by the weaving of a weft of the lower surface side fabric (or the upper surface side fabric) from the reverse surface side (or the obverse surface side) with a warp that should normally be woven with only a weft of the upper surface side fabric (or the lower surface side fabric).

First Embodiment

Figure 1:
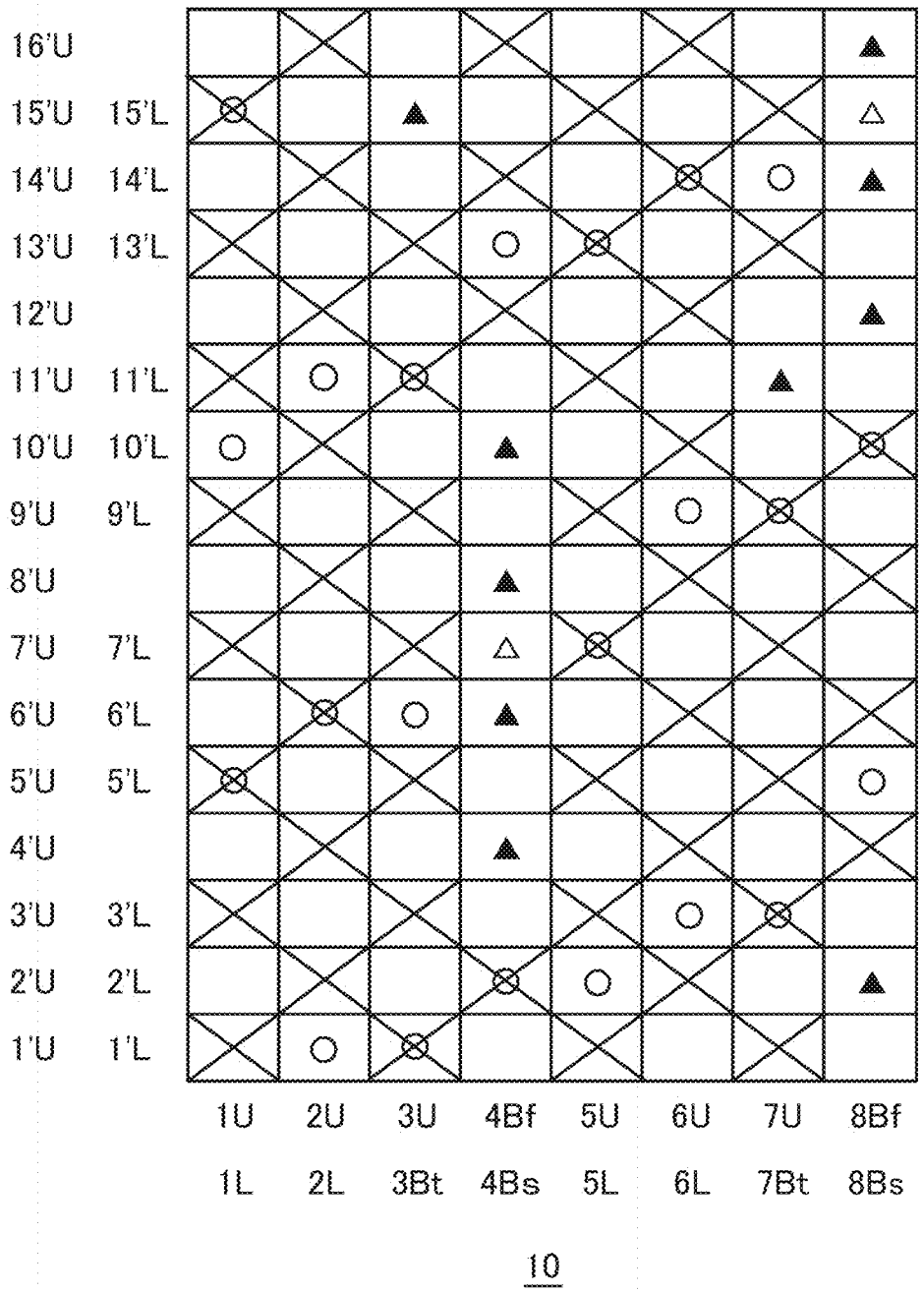
FIG. 1 is a design diagram showing a weave repeat of an industrial fabric according to the first embodiment.

FIG. 1 is a design diagram showing a weave repeat of an industrial fabric 10 according to the first embodiment. FIG. 2 is a cross-sectional view in the warp direction (also referred to as the longitudinal direction) along warps in the design diagram shown in FIG. 1.

In the design diagrams, warps are represented by Arabic numerals, for example, 1, 2, 3, and so on. Wefts are represented by Arabic numerals with a dash, for example, 1', 2', 3', and so on. Upper surface side yarns are denoted by numbers with "U," and lower surface side yarns are denoted by numbers with "L," e.g., l'U, 2'L, etc. Binding warps binding the upper surface side fabric and the lower surface side fabric are denoted by numbers with "B," and first, second, and third binding warps are denoted as Bf, Bs, and Bt, respectively.

In the design diagrams, A marks indicate that first binding warps are arranged below lower surface side wefts, ▲ marks indicate that second or third warps are arranged above upper surface side wefts, x marks indicate that upper surface side warps or the first binding warps are arranged above the upper surface side wefts, and o marks indicate that lower surface side warps, the second binding warps, or the third binding warps are arranged below the lower surface side wefts. The Δ marks, the ▲ marks, the x marks, and the ○ marks indicate knuckles. These notations are used in the same manner in FIG. 3 and subsequent figures.

In an industrial fabric 10 according to the first embodiment shown in FIG. 1, an upper surface side fabric composed of upper surface side warps (1U, 2U, 3U, 5U, 6U, and 7U) and upper surface side wefts (1'U to 16'U) and a lower surface side fabric composed of lower surface side warps (1L, 2L, 5L, and 6L) and lower surface side wefts (1'L to 3'L, 5'L to 7'L, 9'L to 11'L, and 13'L to 15'L) are bound to each other by the first binding warps (4Bf and 8Bf), the second binding warps (4Bs and 8Bs), and the third binding warps (3Bt and 7Bt). The upper surface side wefts (1'U to 16'U) form a part of the upper surface side fabric. The lower surface side wefts (1'L to 3'L, 5'L to 7'L, 9'L to 11'L, and 13'L to 15'L) form a part of the lower surface side fabric. The first binding warps (4Bf and 8Bf), the second binding warps (4Bs and 8Bs), and the third binding warps (3Bt and 7Bt) bind the upper surface side fabric and the lower surface side fabric and each form a part of the upper surface side fabric and a part of the lower surface side fabric. The first binding warps (4Bf and 8Bf), the second binding warps (4Bs and 8Bs), and the third binding warps (3Bt and 7Bt) are simply referred to as binding warps when the binding warps are not distinguished.

Figure 2A:
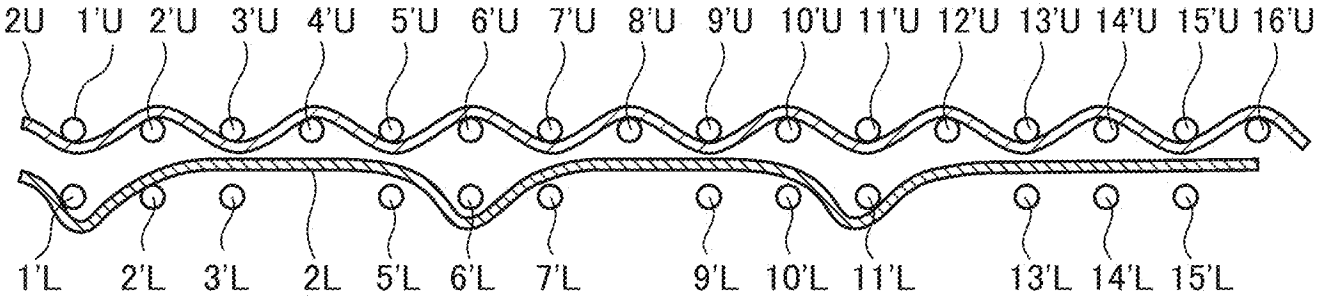
FIGS. 2A, 2B, and 2C are cross-sectional views in the warp direction along warps in the design diagram shown in FIG. 1.
Figure 2B:
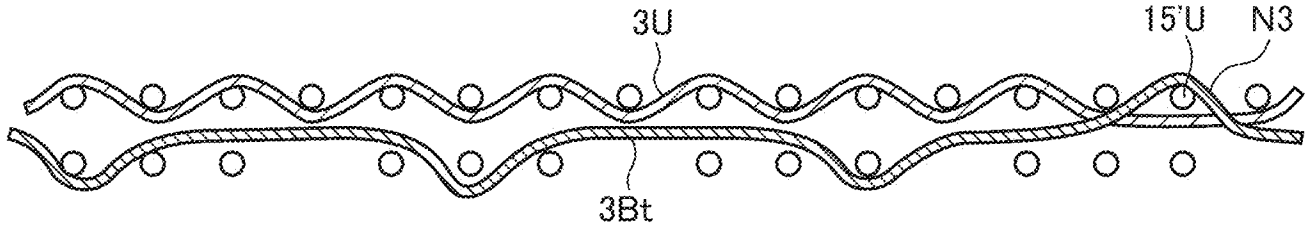
Figure 2C:
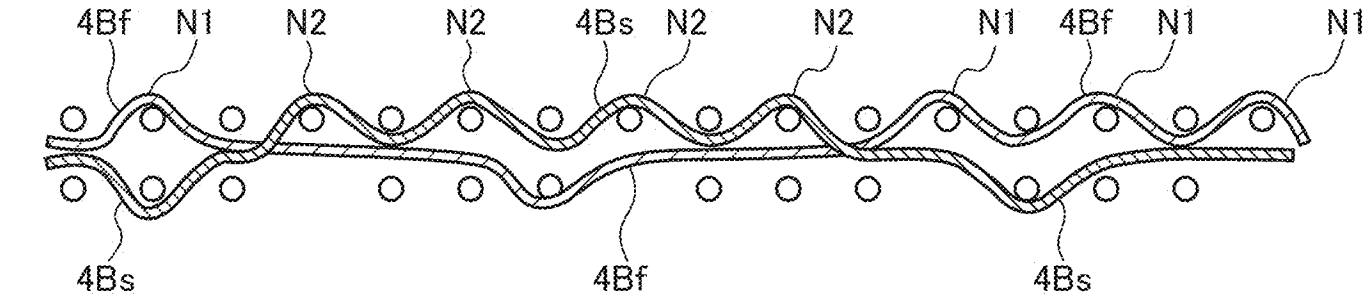

The weaving method of each warp and each weft in the industrial fabric 10 will be explained next with reference to FIGS. 2A to 2C. The upper surface side wefts and the lower surface side wefts shown in FIGS. 2A to 2C are arranged in the same manner. FIG. 2A shows a form in which a pair formed by the upper surface side warp 20 and the lower surface side warp 2L is interwoven with the upper and lower surface side wefts. As shown in FIG. 2A, the upper surface side warp 2U is interwoven with the upper surface side wefts (1'U to 16'U) above and below the upper surface side wefts (1'U to 16'U) one by one, passes above the upper surface side wefts (2'U, 4'U, 6'U, 8'U, 10'U, 12'U, 14'U, and 16'U) so as to form obverse surface side knuckles, and passes below the upper surface side wefts (1'U, 3'U, 5'U, 7'U, 9'U, 11'U, 13'U, and 15'U).

The upper surface side weft 6U is interwoven with the upper surface side wefts (1'U to 16'U) in the same manner as in the upper surface side warp 2U. The upper surface side warps (1U, 3U, 5U, and 7U) are alternately interwoven with the upper surface side wefts (1'U to 16'U) in the same manner as in the upper surface side warp 2U except that the interweaving position is shifted by one in the warp direction. As described, the upper surface side warps (1U to 3U, 5U to 7U) have the same weaving pattern, form knuckles at constant intervals with respect to the upper surface side wefts (1'U to 16'U), and are interwoven alternately without destroying the surface texture. The upper surface side warps (1U, 2U, 3U, 5U, 6U, and 7U) are interwoven only with the upper surface side wefts (1'U to 16'U) so as to form a part of the upper surface side fabric.

The lower surface side warp 2L passes below the lower surface side wefts (1'L, 6'L, and 11'L) so as to form reverse surface side knuckles, respectively, and passes above the three lower surface side wefts (2'L, 3'L, and 5'L), the three lower surface side wefts (7'L, 9'L, and 10'L), and the three lower surface side wefts (13'L, 14'L, and 15'L) between respective reverse surface side knuckles.

The lower surface side warps (1L, 5L, and 6L) have the same weaving pattern as that of the lower surface side warp 2L and are woven passing alternately below one lower surface side weft and above three lower surface side wefts. As described, the lower surface side warps (1L, 2L, 5L, and 6L) are interwoven only with the lower surface side wefts (1'L to 3'L, 5'L to 7'L, 9'L to 11'L, and 13'L to 15'L) so as to form a part of the lower surface side fabric. Being same in the same weaving pattern means that deviations in the warp direction are allowed while the number and spacing of knuckles are the same.

FIG. 2B shows a form in which a pair formed by the upper surface side warp 3U and the third binding warp 3Bt is interwoven with the upper and lower surface side wefts. The upper surface side warp 3U and the third binding warp 3Bt form a pair facing each other vertically and intersect with each other due to the binding by the third binding warp 3Bt.

The upper surface side warp 30 passes above the upper surface side wefts (1'U, 3'U, 5'U, 7'U, 9'U, 11'U, and 13'U) so as to form obverse surface side knuckles, respectively, and passes below the upper surface side wefts (2'U, 4'U, 6'U, 8'U, 10'U, 12'U, and 14'U to 16'U).

The third binding warp 3Bt passes below the lower surface side wefts (1'L, 6'L, and 11'L) so as to form knuckles and forms a knuckle N3 passing above the upper surface side weft 15'U. With respect to the lower surface side wefts (1'L to 3'L, 5'L to 7'L, 9'L to 11'L, and 13'L to 15'L), the third binding warp 3Bt passes below one lower surface side weft and above three lower surface side wefts alternately so as to form knuckles at constant intervals on the lower surface side fabric and are interwoven without destroying the reverse surface texture.

With respect to the upper surface side fabric, the third binding warp 3Bt passes below the upper surface side wefts (1'U to 14'L, and 16'L) and passes above the upper surface side weft 15'U for binding so as to form only one knuckle N3 on the obverse surface side.

At the position where the third binding warp 3Bt forms a knuckle N3 on the obverse surface side, the upper surface side warp 3U does not form a knuckle on the obverse surface side after passing below the upper surface side weft 15'U and acts as an upper surface side collapsing yarn 3U that collapses a part of the upper surface side obverse surface texture.

The upper surface side warp 3U and the third binding warp 3Bt complement each other in the obverse surface texture of the upper surface side fabric, thereby forming the same obverse surface texture as that of the upper surface side warps (1U, 2U, 5U, and 6U) other than the upper surface side warp 3U (upper surface side collapsing yarn) and forming the same number of knuckles as the number of the upper surface side warps (1U, 2U, 5U, and 6U) other than the upper surface side collapsing yarn 30 in the upper surface side obverse surface texture. This prevents the third binding warp 3Bt from lowering the surface properties of the upper surface side fabric. Further, by using a pair formed by the upper surface side collapsing yarn 3U, which is interwoven only with the upper surface side wefts, and the third binding warp 3Bt for the binding, a decrease in the surface properties can be suppressed compared to when binding warps are vertically provided. Although the binding position of the upper surface side warp 70 and the third binding warp 7Bt is shifted in the warp direction from that of the upper surface side warp 3U and the third binding warp 3Bt, the upper surface side warp 7U and the third binding warp 7Bt have the same weaving pattern and thus exhibit the same function.

FIG. 2C shows a form in which a pair formed by the first binding warp 4Bf and the second binding warp 4Bs is interwoven with the upper and lower surface side wefts. The first binding warp 4Bf and the second binding warp 4Bs form a pair facing each other vertically and intersect with each other due to binding.

The first binding warp 4Bf passes above the upper surface side wefts (2'U, 12'U, 14'U, and 16'U) so as to form four knuckles N1 and passes below the remaining upper surface side wefts (1'U, 3'U to 11'U, 13'U, and 15'U). The first binding warp 4Bf passes below the lower surface side weft 7'L so as to form a knuckle and passes above the lower surface side wefts (1'L to 6'L, and 8'L to 15'L).

The second binding warp 4Bs passes above the upper surface side wefts (4'U, 6'U, 8'U, and 10'U) so as to form four knuckles N2 and passes below the remaining upper surface side wefts (1'U to 3'U, 5'U, 7'U, 9'U, and 11'U to 16'U). The second binding warp 4Bs passes below the lower surface side wefts (2'L and 13'L) so as to form knuckles, respectively, and passes above the lower surface side wefts (1'L, 3'L to 12'L, and 14'L to 15'L).

In this manner, the first binding warp 4Bf and the second binding warp 4Bs complement each other in the obverse surface texture of the upper surface side fabric, thereby forming the same obverse surface texture as that of the upper surface side warps (1U, 20, 5U, and 6U) other than the upper surface side collapsing yarn and forming the same number of knuckles as the number of the upper surface side warps (1U, 2U, 5U, and 6U) other than the upper surface side collapsing yarn in the upper surface side obverse surface texture. Further, the first binding warp 4Bf and the second binding warp 4Bs complement each other in the reverse surface texture of the lower surface side fabric, thereby forming knuckles at constant intervals on the lower surface side fabric and being interwoven without destroying the reverse surface texture. Although the intersecting position of the first binding warp 8Bf and the second binding warp 8Bs is shifted in the warp direction from that of the first binding warp 4Bf and the second binding warp 4Bs, the first binding warp 8Bf and the second binding warp 8Bs have the same weaving pattern and thus exhibit the same function.

The pair formed by the first binding warp 4Bf and the second binding warp 4Bs is adjacent to the pair formed by the third binding warp 3Bt and the upper surface side collapsing yarn 3U. This allows the binding of the upper surface side fabric and the lower surface side fabric to be strong. Since the pair formed by the first and second binding warps 8Bf and 8Bs and the pair formed by the third binding warp 7Bt and the upper surface side collapsing yarn 7U have the same relationship as the pair formed by the first and second binding warps 4Bf and 4Bs and the pair formed by the third binding warp 3Bt and the upper surface side collapsing yarn 3U, the explanations thereof are omitted.

In the weave repeat, the pair formed by the first binding warp 4Bf and the second binding warp 4Bs complement each other while the pair formed by the third binding warp 3Bt and the upper surface side collapsing yarn 3U complement each other. Thereby, the pair formed by the first binding warp 4Bf and the second binding warp 4Bs and the pair formed by the third binding warp 3Bt and the upper surface side collapsing yarn 3U form the same weaving pattern for the upper surface side wefts (1'U to 16'U). The pair formed by the first binding warp 4Bf and second binding warp 4Bs forms obverse surface texture in which knuckles are formed for every other upper surface side weft (1'U to 16'U) on the obverse surface side. The pair formed by the third binding warp 3Bt and the upper surface side collapsing yarn 3U also forms obverse surface texture in which knuckles are formed for every other upper surface side weft (1'U to 16'U) on the obverse surface side. In this manner, the pair formed by the first binding warp 4Bf and the second binding warp 4Bs and the pair formed by the third binding warp 3Bt and the upper surface side collapsing yarn 3U form common obverse surface texture, thereby suppressing a decrease in the surface properties of the upper surface side fabric caused due to binding.

The upper surface side collapsing yarn 3U is arranged below the upper surface side weft 15'U at the position of the knuckle N3 formed by the third binding warp 3Bt passing above the upper surface side weft 15'U. Thus, the pulling-in of the upper surface side weft 15'U due to the binding can be suppressed by the upper surface side collapsing yarn 3U. This allows for suppression of a decrease in the surface properties of the upper surface side fabric. The number of knuckles N3 formed by the third binding warp 3Bt passing above the upper surface side weft 15'U is less than the number of knuckles N1 formed by the first binding warp 4Bf passing above the upper surface side weft. Further, the number of the knuckles N3 is less than the number of the knuckles N2. Thereby, a decrease in the surface properties can be suppressed in the row of the third binding warp 3Bt.

The number of all the warps (1U to 3U, 4Bf, 5U to 7U, 8Bf, 1L to 2L, 3Bt, 4Bs, 5L to 6L, 7Bt, and 8Bs) forming the weave repeat is a multiple of four. This works for various structures such as plain weave, twill weave, 2/2 weave where threads alternately pass above and below two wefts, 4-shaft weave, 8-shaft weave, and 16-shaft weave.

In the weave repeat, the number of the first binding warps (4Bf and 8Bf), the second binding warps (4Bs and 8Bs), and the third binding warps (3Bt and 7Bt) combined is less than half the number of all the warps (1U to 3U, 4Bf, 5U to 7U, 8Bf, 1L to 2L, 3Bt, 4Bs, 5L to 6L, 7Bt, and 8Bs). Thereby, the number of binding yarns can be reduced such that a decrease in the air permeability and the surface properties can be suppressed.

The third binding warp 3Bt and the upper surface side collapsing yarn 3U complement each other in the weave repeat such that the number and spacing of knuckles formed on the upper surface side wefts are the same as the number and spacing of knuckles formed by the upper surface side warps (1U, 2U, 5U, and 6U) other than the upper surface side collapsing yarn 3U on the upper surface side wefts. This allows for suppression of a decrease in the surface properties of the upper surface side fabric.

The first binding warp 4Bf and the second binding warp 4Bs complement each other in the weave repeat such that the number of knuckles formed on the upper surface side wefts (N2 and N3) is the same as the number of knuckles formed by the upper surface side warps (1U, 2U, 5U, and 6U) other than the upper surface side collapsing yarn 30 on the upper surface side wefts. This allows for suppression of a decrease in the surface properties of the upper surface side fabric.

Second Embodiment

Figure 3:
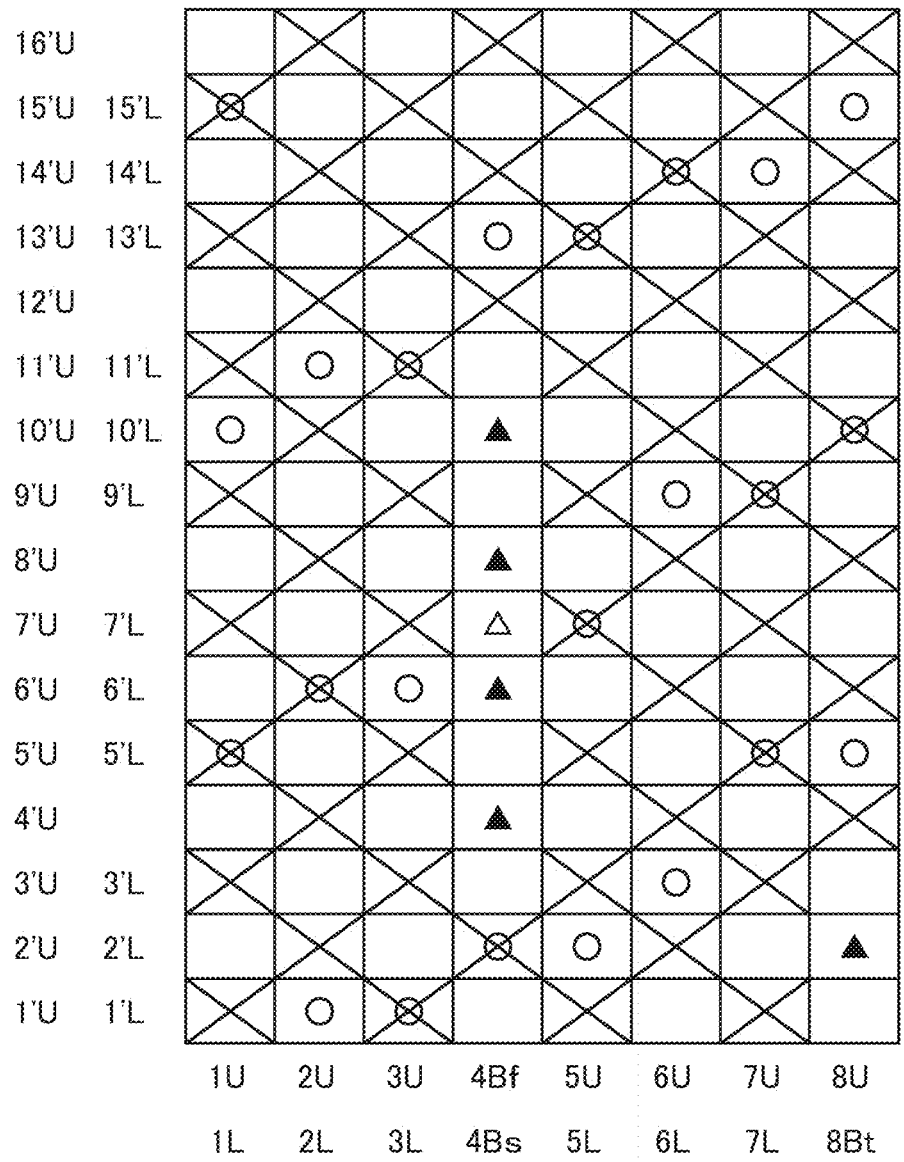
FIG. 3 is a design diagram showing a weave repeat of an industrial fabric according to the second embodiment.

FIG. 3 is a design diagram showing a weave repeat of an industrial fabric 20 according to the second embodiment. FIG. 4 is a cross-sectional view in the warp direction along warps in the design diagram shown in FIG. 3.

In the industrial fabric 20 according to the second embodiment shown in FIG. 3, an upper surface side fabric composed of upper surface side warps (1U to 3U, and 5U to 8U) and upper surface side wefts (1'U to 16'U) and a lower surface side fabric composed of lower surface side warps (1L to 3L and 5L to 7L) and lower surface side wefts (1'L to 3'L, 5'L to 7'L, 9'L to 11'L, and 13'L to 15'L) are bound to each other by the first binding warp 4Bf, the second binding warp 4Bs, and the third binding warp 8Bt. The upper surface side wefts (1'U to 16'U) form a part of the upper surface side fabric. The lower surface side wefts (1'L to 3'L, 5'L to 7'L, 9'L to 11'L, and 13'L to 15'L) form a part of the lower surface side fabric. The first binding warp 4Bf, the second binding warp 4Bs, and the third binding warp 8Bt bind the upper surface side fabric and the lower surface side fabric and each form a part of the upper surface side fabric and a part of the lower surface side fabric.

Figure 4A:
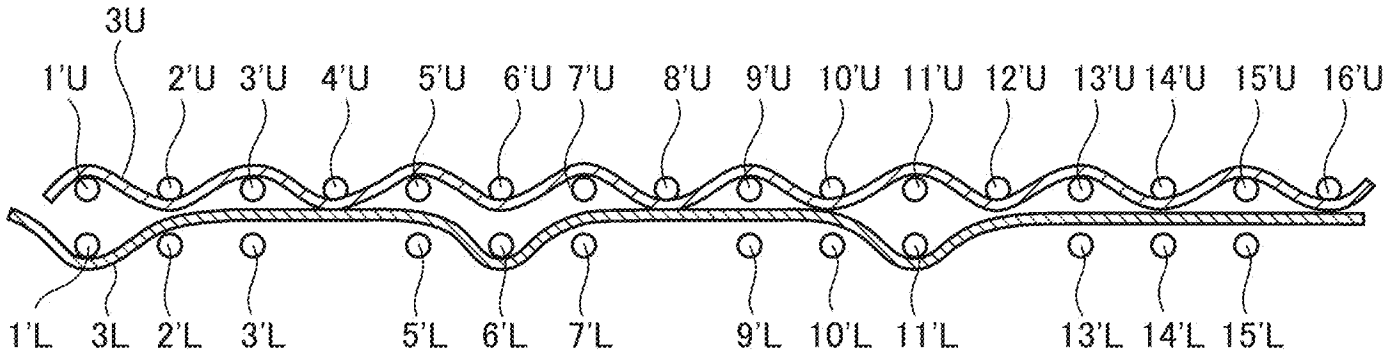
FIGS. 4A, 4B, and 4C are cross-sectional views in the warp direction along warps in the design diagram shown in FIG. 3.
Figure 4B:
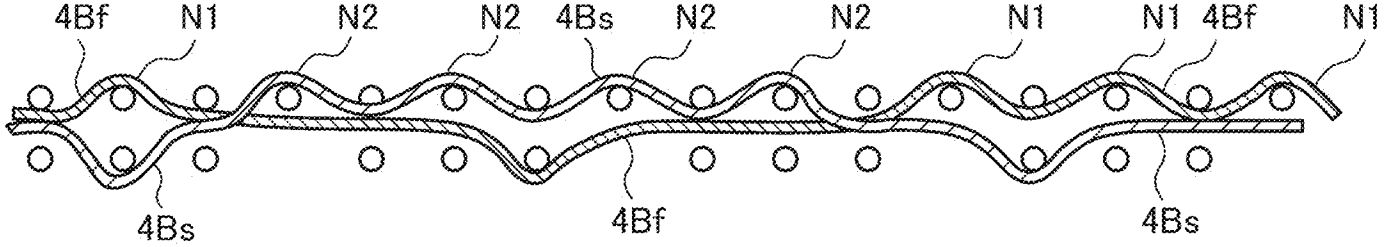
Figure 4C:
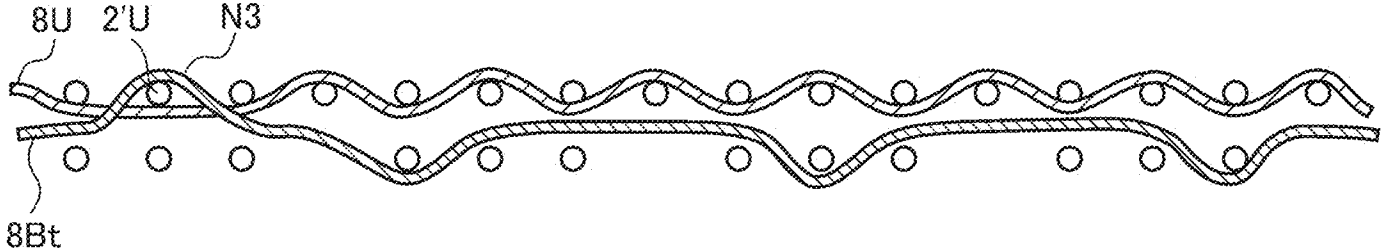

FIG. 4A shows a form in which a pair formed by the upper surface side warp 30 and the lower surface side warp 3L is interwoven with the upper and lower surface side wefts. The upper surface side wefts and the lower surface side wefts shown in FIGS. 4A to 4C are arranged in the same manner. As shown in FIG. 4A, the upper surface side warp 3U is interwoven with the upper surface side wefts (1'U to 16'U) above and below the upper surface side wefts one by one, passes above the upper surface side wefts (1'U, 3'U, 5'U, 7'U, 9'U, 11'U, 13'U, and 15'U) so as to form obverse surface side knuckles, and passes below the upper surface side wefts (2'U, 4'U, 6'U, 8'U, 10'U, 12'U, 14'U, and 16'U).

The upper surface side weft 6U is interwoven with the upper surface side wefts (1'U to 16'U) in the same manner as in the upper surface side warp 20. The upper surface side warps (1U, 3U, 5U, 7U) are alternately interwoven with the upper surface side wefts (1'U to 16'U) in the same manner as in the upper surface side warp 2U except that the interweaving position is shifted by one in the warp direction. As described, the upper surface side warps (1U to 3U, 5U to 7U) have the same weaving pattern, form knuckles at constant intervals with respect to the upper surface side wefts (1'U to 16'U), and are interwoven alternately without destroying the obverse side surface texture. The upper surface side warps (1U to 30, 5U to 7U) are interwoven only with the upper surface side wefts (1'U to 16'U) so as to form a part of the upper surface side fabric.

The lower surface side warp 3L passes below the lower surface side wefts (1'L, 6'L, and 11'L) so as to form reverse surface side knuckles, respectively, and passes above the three lower surface side wefts (2'L, 3'L, and 5'L), the three lower surface side wefts (7'L, 9'L, and 10'L), and the three lower surface side wefts (13'L, 14'L, and 15'L) between respective reverse surface side knuckles.

The lower surface side warps (1L to 2L and 5L to 7L) have the same weaving pattern as that of the lower surface side warp 3L and are woven passing alternately below one lower surface side weft and above three lower surface side wefts. As described, the lower surface side warps (1L to 3L and 5L to 7L) are interwoven only with the lower surface side wefts (1'L to 3'L, 5'L to 7'L, 9'L to 11'L, and 13'L to 15'L) so as to form a part of the lower surface side fabric.

FIG. 4B shows a form in which a pair formed by the first binding warp 4Bf and the second binding warp 4Bs is interwoven with the upper and lower surface side wefts. The first binding warp 4Bf and the second binding warp 4Bs form a pair facing each other vertically and intersect with each other due to binding.

The first binding warp 4Bf passes above the upper surface side wefts (2'U, 12'U, 14'U, and 16'U) so as to form four knuckles N1 and passes below the remaining upper surface side wefts (1'U, 3'U to 11'U, 13'U, and 15'U). The first binding warp 4Bf passes below the lower surface side weft 7'L so as to form a knuckle and passes above the lower surface side wefts (1'L to 6'L and 8'L to 15'L).

The second binding warp 4Bs passes above the upper surface side wefts (4'U, 6'U, 8'U, and 10'U) so as to form four knuckles N2 and passes below the remaining upper surface side wefts (1'U to 3'U, 5'U, 7'U, 9'U, and 11'U to 16'U). The second binding warp 4Bs passes below the lower surface side wefts (2'L and 13'L) so as to form knuckles, respectively, and passes above the lower surface side wefts (1'L, 3'L to 12'L, and 14'L to 15'L).

In this manner, the first binding warp 4Bf and the second binding warp 4Bs complement each other in the obverse surface texture of the upper surface side fabric, thereby forming the same obverse surface texture as that of the upper surface side warps (1U to 3U and 5U to 7U) and forming the same number of knuckles as the number of the upper surface side warps (1U to 30 and 5U to 7U) in the upper surface side obverse surface texture. Further, the first binding warp 4Bf and the second binding warp 4Bs complement each other in the reverse surface texture of the lower surface side fabric, thereby forming knuckles at constant intervals on the lower surface side fabric and being interwoven without destroying the reverse surface texture.

FIG. 4C shows a form in which a pair formed by the upper surface side warp 8U and the third binding warp 8Bt is interwoven with the upper and lower surface side wefts. The upper surface side warp 8U and the third binding warp 8Bt form a pair facing each other vertically and intersect with each other due to the binding by the third binding warp 8Bt.

The upper surface side warp 8U passes above the upper surface side wefts (4'U, 6'U, 8'U, 10'U, 12'U, 14'U, and 16'U) so as to form obverse surface side knuckles, respectively, and passes below the upper surface side wefts (1'U, 2'U, 3'U, 5'U, 7'U, 9'U, 11'U, and 13'U to 15'U).

The third binding warp 8Bt forms a knuckle N3 that passes above the upper surface side weft 2'U and passes below the lower surface side wefts (5'L, 10'L, and 15'L) so as to form knuckles. With respect to the lower surface side wefts (1'L to 3'L, 5'L to 7'L, 9'L to 11'L, and 13'L to 15'L), the third binding warp 8Bt passes below one lower surface side weft and above three lower surface side wefts alternately so as to form knuckles at constant intervals on the lower surface side fabric and are interwoven without destroying the reverse surface texture.

With respect to the upper surface side fabric, the third binding warp 8Bt passes below the upper surface side wefts (1'U and 3'U to 16'U) and passes above the upper surface side weft 2'U for binding so as to form only one knuckle N3 on the obverse surface side.

At the position where the third binding warp 8Bt forms a knuckle N3 on the obverse surface side, the upper surface side warp 8U does not form a knuckle on the obverse surface side after passing below the upper surface side weft 2'U and acts as an upper surface side collapsing yarn 8U that collapses a part of the upper surface side obverse surface texture.

The upper surface side warp 8U and the third binding warp 8Bt complement each other in the obverse surface texture of the upper surface side fabric, thereby forming the same obverse surface texture as that of the upper surface side warps (1U to 3U and 5U to 7U) other than the upper surface side warp 8U (upper surface side collapsing yarn) and forming the same number of knuckles as the number of the upper surface side warps (1U to 3U and 5U to 7U) other than the upper surface side collapsing yarn 8U in the upper surface side obverse surface texture. This prevents the third binding warp 8Bt from lowering the surface properties of the upper surface side fabric. The upper surface side collapsing yarn 8U is arranged below the upper surface side weft 2'U at the position of the knuckle N3 formed by the third binding warp 8Bt. Thus, the pulling-in of the upper surface side weft 2'U due to the binding of the third binding warp 8Bt can be suppressed by the upper surface side collapsing yarn 8U. This allows for suppression of a decrease in the surface properties of the upper surface side fabric. By using a pair formed by the upper surface side collapsing yarn 8U, which is interwoven only with the upper surface side wefts, and the third binding warp 8Bt for the binding, a decrease in the surface properties and a decrease in the air permeability can be suppressed compared to when binding warps are vertically provided.

In the weave repeat, the pair formed by the first binding warp 4Bf and the second binding warp 4Bs complement each other while the pair formed by the third binding warp 8Bt and the upper surface side collapsing yarn 8U complement each other. Thereby, the pair formed by the first binding warp 4Bf and the second binding warp 4Bs and the pair formed by the third binding warp 8Bt and the upper surface side collapsing yarn 8U form the same weaving pattern for the upper surface side wefts (1'U to 16'U). Having the same weaving pattern means that knuckles are arranged at the same intervals, and those with deviations in the warp direction are also included. The pair formed by the first binding warp 4Bf and second binding warp 4Bs forms obverse surface texture in which knuckles are formed for every other upper surface side weft (1'U to 16'U) on the obverse surface side. The pair formed by the third binding warp 3Bt and the upper surface side collapsing yarn 3U also forms obverse surface texture in which knuckles are formed for every other upper surface side weft (1'U to 16'U) on the obverse surface side. In this manner, the pair formed by the first binding warp 4Bf and the second binding warp 4Bs and the pair formed by the third binding warp 8Bt and the upper surface side collapsing yarn 8U form common obverse surface texture, thereby suppressing a decrease in the surface properties of the upper surface side fabric caused due to binding.

The pair formed by the first binding warp 4Bf and the second binding warp 4Bs is not adjacent to the pair formed by the third binding warp 8Bt and the upper surface side collapsing yarn 8U. Thereby, it is possible to disperse the binding positions that cause a decrease in the surface properties and to suppress the occurrence of marks on paper produced by the industrial fabric 20 compared to a case where binding positions are closely packed.

In the weave repeat, the number of the first binding warps 4Bf, the second binding warp 4Bs, and the third binding warp 8Bt combined is less than half the number of all the warps (1U to 3U, 4Bf, 5U to 8U, 1L to 3L, 4Bs, 5L to 7L, and 8Bt). Thereby, the number of binding yarns can be reduced such that a decrease in the air permeability and the surface properties can be suppressed.

The number of all the warps (1U to 3U, 4Bf, 5U to 8U, 1L to 3L, 4Bs, 5L to 7L, and 8Bt) forming the weave repeat is a multiple of four. This works for various structures such as plain weave, twill weave, 2/2 weave where threads alternately pass above and below two wefts, 4-shaft weave, 8-shaft weave, and 16-shaft weave.

Third Embodiment

Figure 5:
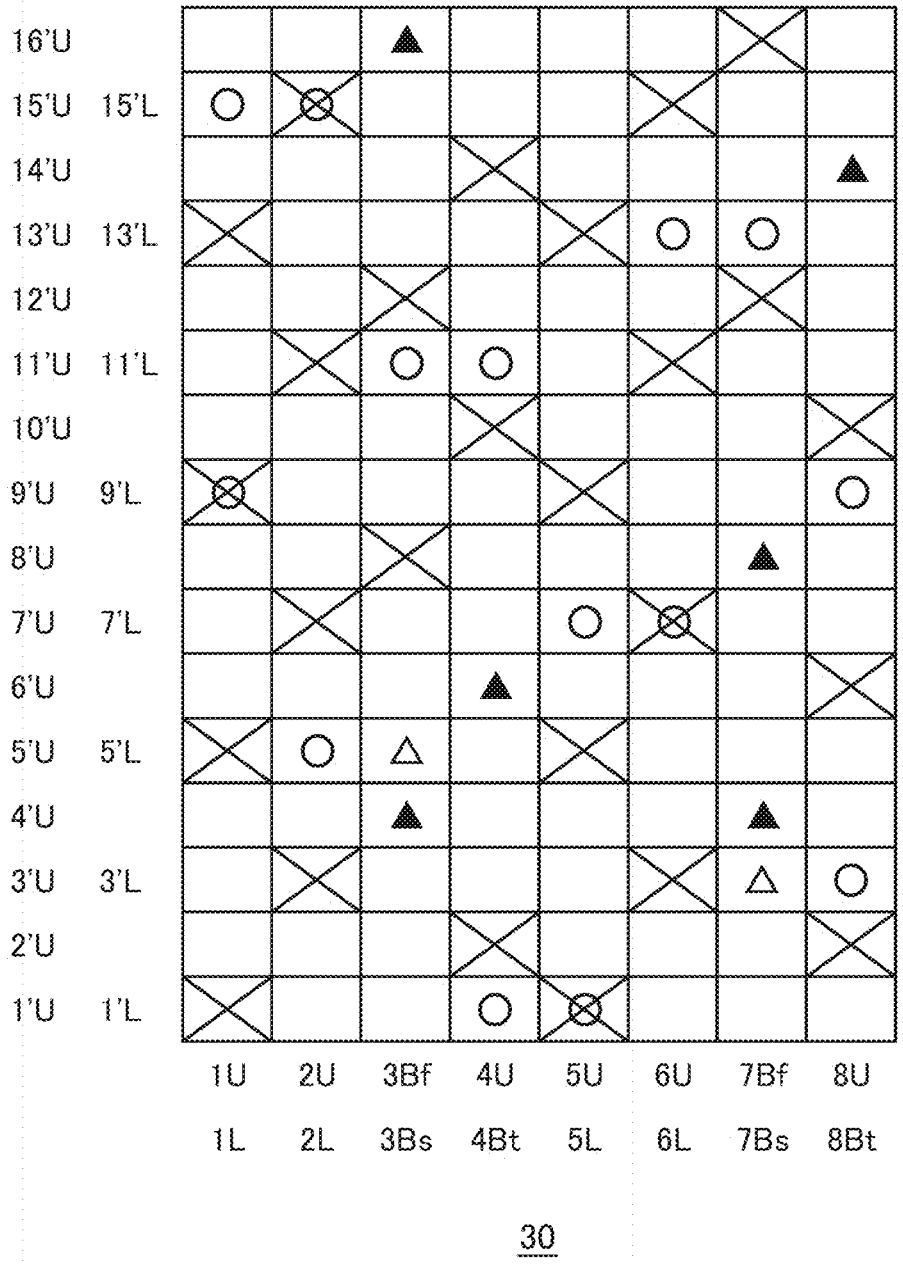
FIG. 5 is a design diagram showing a weave repeat of an industrial fabric according to the third embodiment.

FIG. 5 is a design diagram showing a weave repeat of an industrial fabric 30 according to the third embodiment. FIG. 6 is a cross-sectional view in the warp direction along warps in the design diagram shown in FIG. 5.

In an industrial fabric 30 according to the third embodiment shown in FIG. 5, an upper surface side fabric formed including upper surface side warps (1U, 2U, 4U, 5U, 6U, and 8U) and upper surface side wefts (1'U to 16'U) and a lower surface side fabric composed of lower surface side warps (1L, 2L, 5L, and 6L) and lower surface side wefts (1'L to 3'L, 5'L to 7'L, 9'L to 11'L, 13'L, and 15'L) are bound to each other by the first binding warps (3Bf and 7Bf), the second binding warps (3Bs and 7Bs), and the third binding warps (4Bt and 8Bt). The upper surface side wefts (1'U to 16'U) form a part of the upper surface side fabric. The lower surface side wefts (1'L, 3'L, 5'L, 7'L, 9'L, 11'L, 13'L, and 15'L) form a part of the lower surface side fabric. The first binding warps (3Bf and 7Bf), the second binding warps (3Bs and 7Bs), and the third binding warps (4Bt and 8Bt) bind the upper surface side fabric and the lower surface side fabric and each form a part of the upper surface side fabric and a part of the lower surface side fabric.

Figure 6A:
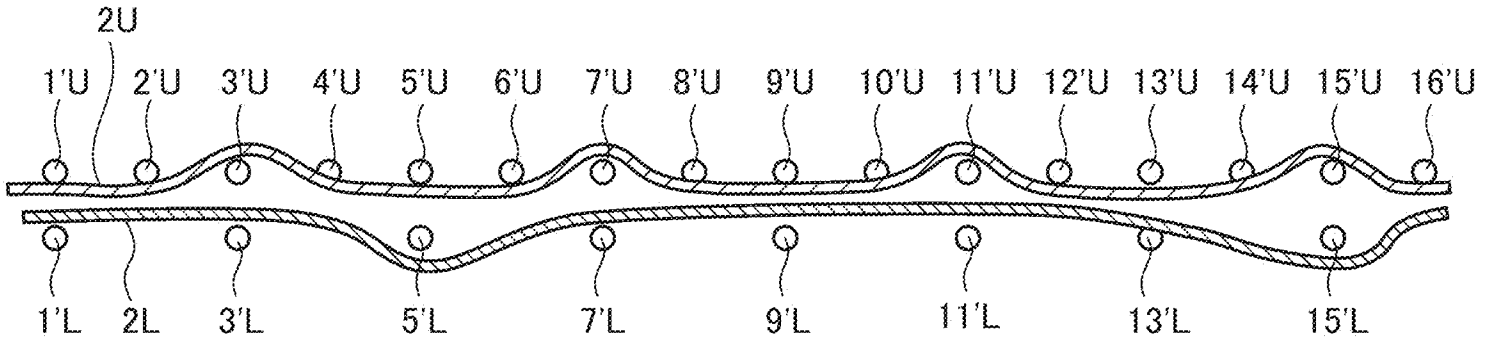
FIGS. 6A, 6B, and 6C are cross-sectional views in the warp direction along warps in the design diagram shown in FIG. 5.
Figure 6B:
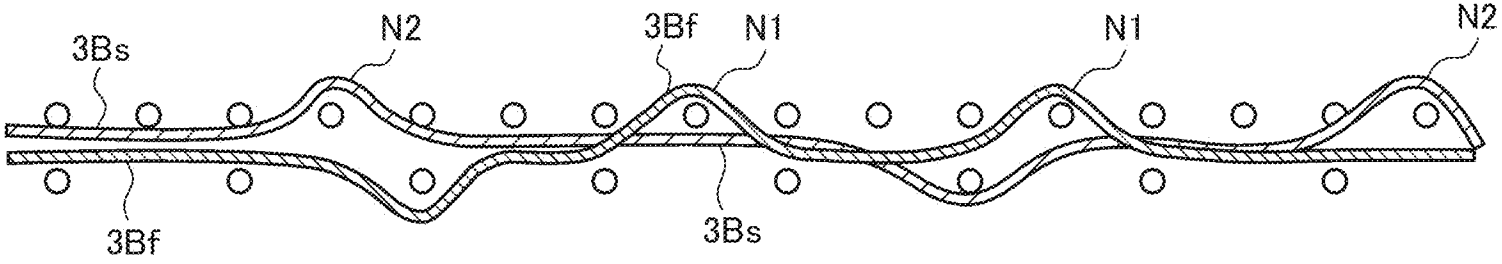
Figure 6C:
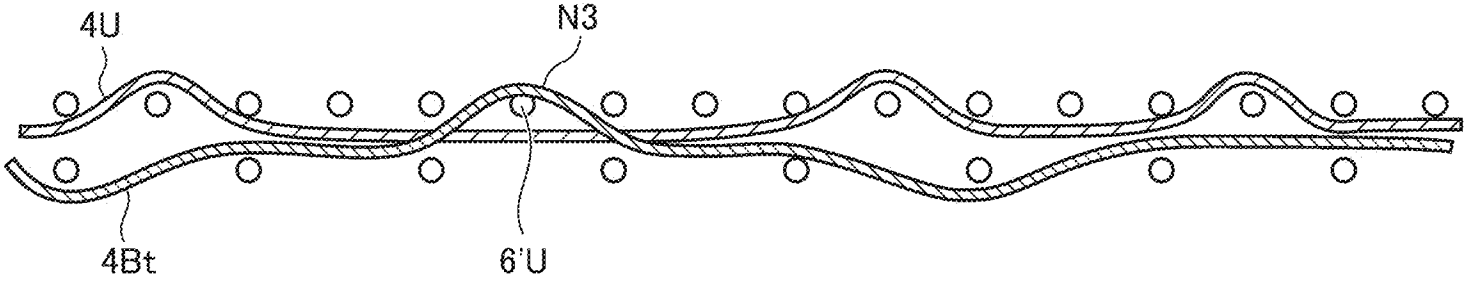

The upper surface side wefts and the lower surface side wefts shown in FIGS. 6A to 6C are arranged in the same manner. FIG. 6A shows a form in which a pair formed by the upper surface side warp 2U and the lower surface side warp 2L is interwoven with the upper and lower surface side wefts. As shown in FIG. 6A, the upper surface side warp 2U is interwoven with the upper surface side weft (1'U to 16'U) alternately in a ratio of one weft above and three wefts below the upper surface side warp 2U, passes above the upper surface side wefts (3'U, 7'U, 11'U, and 15'U) so as to form obverse surface side knuckles, and passes below the upper surface side wefts (1'U, 2'U, 4'U to 6'U, 8'U to 10'U, 12'U to 14'U, and 16'U).

The other upper surface side warps (1U, 3U to 6U, and 7U) have the same weaving pattern as that of the upper surface side warp 2U, interwoven with the upper surface side weft (1'U to 16'U) alternately in a ratio of one weft above and three wefts below the upper surface side warps, and are interwoven without destroying the obverse side surface texture. The upper surface side warps (1U, 2U, 4U to 6U, and 8U) are interwoven only with the upper surface side wefts (1'U to 16'U) so as to form a part of the upper surface side fabric.

The lower surface side warp 2L passes below the lower surface side wefts (5'L and 15'L) so as to form reverse surface side knuckles, respectively, and passes above the two lower surface side wefts (1'L and 3'L) and the four lower surface side wefts (7'L, 9'L, 11'L, and 13'L) between respective reverse surface side knuckles.

The other lower surface side warps (1L, 5L, and 6L) have the same weaving pattern as that of the lower surface side warp 2L, each form two reverse surface side knuckles, and are woven passing above two lower surface side wefts and four lower surface side wefts between the reverse surface side knuckles. As described, the lower surface side warps (1L, 2L, 5L, and 6L) are interwoven only with the lower surface side wefts (1'L, 3'L, 5'L, 7'L, 9'L, 11'L, 13'L, and 15'L) so as to form a part of the lower surface side fabric.

FIG. 6B shows a form in which a pair formed by the first binding warp 3Bf and the second binding warp 3Bs is interwoven with the upper and lower surface side wefts. The first binding warp 3Bf and the second binding warp 3Bs form a pair facing each other vertically and intersect with each other due to binding.

The first binding warp 3Bf passes above the upper surface side wefts (8'U and 12'U) so as to form two knuckles N1 and passes below the remaining upper surface side wefts (1'U to 7'U, 9'U to 11'U, and 13'U to 16'U). The first binding warp 3Bf passes below the lower surface side weft 5'L so as to form a knuckle and passes above the lower surface side wefts (1'L, 3'L, 7'L, 9'L, 11'L, 13'L, and 15'L).

The second binding warp 3Bs passes above the upper surface side wefts (4'U and 16'U) so as to form two knuckles N2 and passes below the remaining upper surface side wefts (1'U to 3'U, and 5'U to 15'U). The second binding warp 3Bs passes below the lower surface side weft 11'L so as to form a knuckle and passes above the lower surface side wefts (1'L, 3'L, 5'L, 7'L, 9'L, 13'L, and 15'L).

The first binding warp 3Bf and the second binding warp 3Bs complement each other in the obverse surface texture of the upper surface side fabric, thereby forming knuckles (N1 and N2) at constant intervals on the upper surface side fabric and being interwoven without destroying the obverse surface texture. Further, the first binding warp 3Bf and the second binding warp 3Bs complement each other in the reverse surface texture of the lower surface side fabric, thereby forming knuckles at constant intervals on the lower surface side fabric and being interwoven without destroying the reverse surface texture.

FIG. 6C shows a form in which a pair formed by the upper surface side warp 4U and the third binding warp 4Bt is interwoven with the upper and lower surface side wefts. The upper surface side warp 4U and the third binding warp 4Bt form a pair facing each other vertically and intersect with each other due to the binding by the third binding warp 4Bt.

The upper surface side warp 4U passes above the upper surface side wefts (2'U, 10'U, and 14'U) so as to form obverse surface side knuckles, respectively, and passes below the upper surface side wefts (1'U, 3'U to 9'U, 11'U to 13'U, 15'U, and 16'U).

The third binding warp 4Bt passes below the lower surface side wefts (1'L and 11'L) so as to form reverse surface side knuckles and forms a knuckle N3 passing above the upper surface side weft 6'U. The third binding warp 4Bt passes above four lower surface side wefts (3'L, 5'L, 7'L, and 9'L) between the respective reverse surface side knuckles and above two lower surface side wefts (13'L and 15'L). The third binding warp 4Bt is interwoven with the lower surface side fabric in the same weaving pattern as that of the lower surface side warps (1L, 2L, 5L, and 6L) and is interwoven without destroying the reverse surface texture.

At the position where the third binding warp 4Bt forms a knuckle N3 on the obverse surface side, the upper surface side warp 4U does not form a knuckle on the obverse surface side after passing below the upper surface side weft 6'U and acts as an upper surface side collapsing yarn 4U that collapses a part of the upper surface side obverse surface texture. The pair formed by the upper surface side warp 8U and the third binding warp 8Bt also has the same weaving pattern as that of the upper surface side warp 4U and the third binding warp 4Bt and thus exhibit the same function. Therefore, an explanation will be given mainly of the upper surface side warp 4U and the third binding warp 4Bt.

The upper surface side warp 4U and the third binding warp 4Bt complement each other in the obverse surface texture of the upper surface side fabric, thereby forming the same obverse surface texture as that of the upper surface side warps (1U, 2U, 5U, and 6U) other than the upper surface side collapsing yarn (upper surface side warps 4U and 8U) and forming the same number of knuckles arranged at the same intervals as those of the upper surface side warps (1U, 2U, 5U, and 6U) other than the upper surface side collapsing yarn (upper surface side warps 4U and 8U) in the upper surface side obverse surface texture. This prevents the third binding warp 4Bt from lowering the surface properties of the upper surface side fabric. Further, by using a pair formed by the upper surface side collapsing yarn 4U, which is interwoven only with the upper surface side wefts, and the third binding warp 4Bt for the binding, a decrease in the surface properties can be suppressed compared to when binding warps are vertically provided.

In the weave repeat, the pair formed by the first binding warps (3Bf and 7Bf) and the second binding warps (3Bs and 7Bs) complement each other while the pair formed by the third binding warps (4Bt and 8Bt) and the upper surface side collapsing yarns (4U and 8U) complement each other. Thereby, the pair formed by the first binding warps (3Bf and 7Bf) and the second binding warps (3Bs and 7Bs) and the pair formed by the third binding warps (4Bt and 8Bt) and the upper surface side collapsing yarns (4U and 8U) form the same obverse surface texture for the upper surface side wefts (1'U to 16'U). The pair formed by the first binding warps (3Bf and 7Bf) and the second binding warps (3Bs and 7Bs) forms obverse surface texture in which knuckles are each formed for every three upper surface side wefts (1'U to 16'U) skipped on the obverse surface side. The pair formed by the third binding warps (4Bt and 8Bt) and the upper surface side collapsing yarns (4U and 8U) also forms obverse surface texture in which knuckles are each formed for every three upper surface side wefts (1'U to 16'U) skipped on the obverse surface side. In this manner, the pair formed by the first binding warps (3Bf and 7Bf) and the second binding warps (3Bs and 7Bs) and the pair formed by the third binding warps (4Bt and 8Bt) and the upper surface side collapsing yarns (4U and 8U) form common obverse surface texture on the obverse surface side, thereby suppressing a decrease in the surface properties of the upper surface side fabric caused due to binding.

The pair formed by the first binding warps (3Bf and 7Bf) and the second binding warps (3Bs and 7Bs) is adjacent to the pair formed by the third binding warps (4Bt and 8Bt) and the upper surface side collapsing yarns (4U and 8U). This causes the bound parts to be placed close to each other such that the upper and lower surface side fabrics are firmly bound.

The number of all the warps forming the weave repeat is a multiple of four. This works for various structures such as plain weave, twill weave, 2/2 weave where threads alternately pass above and below two wefts, 4-shaft weave, 8-shaft weave, and 16-shaft weave.

In the weave repeat, the number of the first binding warps (3Bf and 7Bf), the second binding warps (3Bs and 7Bs), and the third binding warps (4Bt and 8Bt) combined is less than half the number of all the warps. Thereby, the number of binding yarns can be reduced such that a decrease in the air permeability and the surface properties can be suppressed.

Fourth Embodiment

Figure 7:
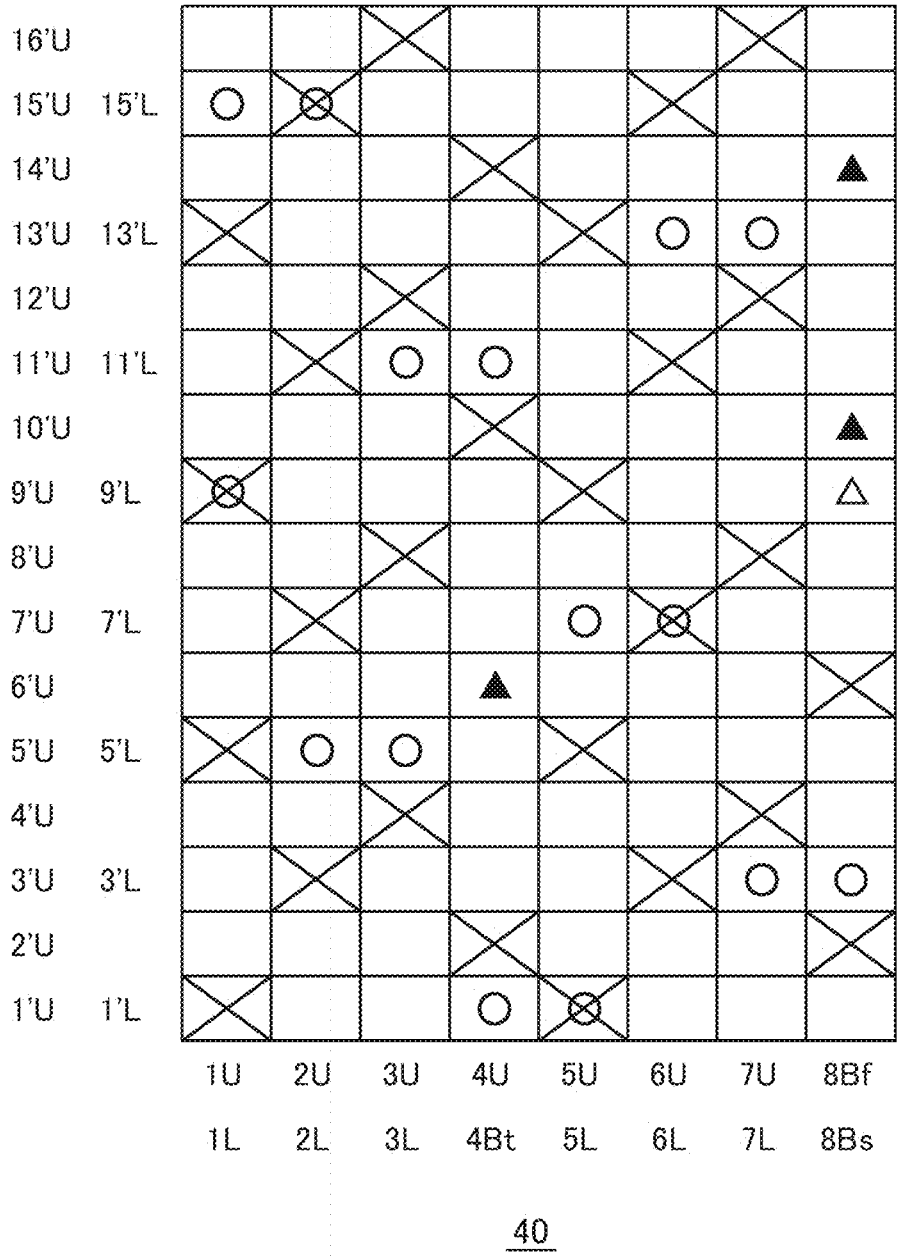
FIG. 7 is a design diagram showing a weave repeat of an industrial fabric according to the fourth embodiment.

FIG. 7 is a design diagram showing a weave repeat of an industrial fabric 40 according to the fourth embodiment. FIG. 8 is a cross-sectional view in the warp direction along warps in the design diagram shown in FIG. 7.

In the industrial fabric 40 according to the fourth embodiment shown in FIG. 7, an upper surface side fabric formed including upper surface side warps (1U to 7U) and upper surface side wefts (l'U to 16'U) and a lower surface side fabric composed of lower surface side warps (1L to 3, 5L to 7L) and lower surface side wefts (1'L, 3'L, 5'L, 7'L, 9'L, 11'L, 13'L, and 15'L) are bound to each other by the first binding warp 8Bf, the second binding warp 8Bs, and the third binding warp 4Bt. The upper surface side wefts (l'U to 16'U) form a part of the upper surface side fabric. The lower surface side wefts (1'L, 3'L, 5'L, 7'L, 9'L, 11'L, 13'L, and 15'L) form a part of the lower surface side fabric. The first binding warp 8Bf, the second binding warp 8Bs, and the third binding warp 4Bt bind the upper surface side fabric and the lower surface side fabric and each form a part of the upper surface side fabric and a part of the lower surface side fabric.

Figure 8A:
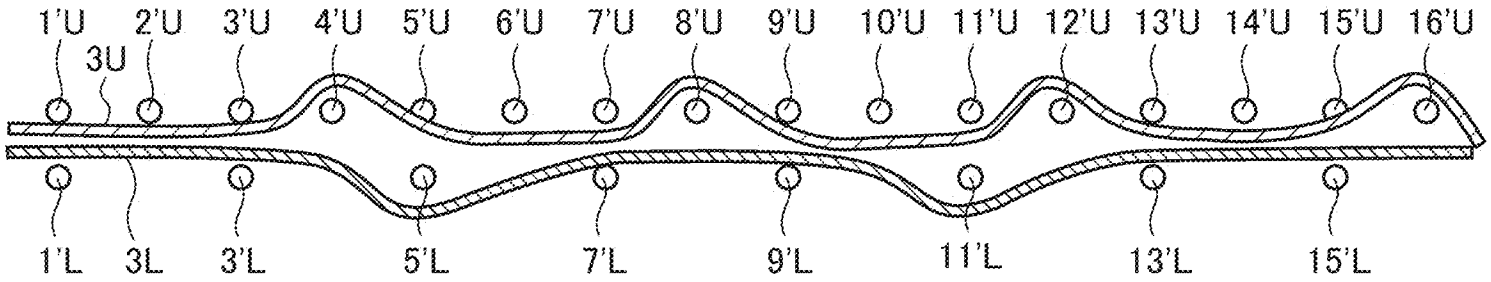
FIGS. 8A, 8B, and 8C are cross-sectional views in the warp direction along warps in the design diagram shown in FIG. 7.
Figure 8B:
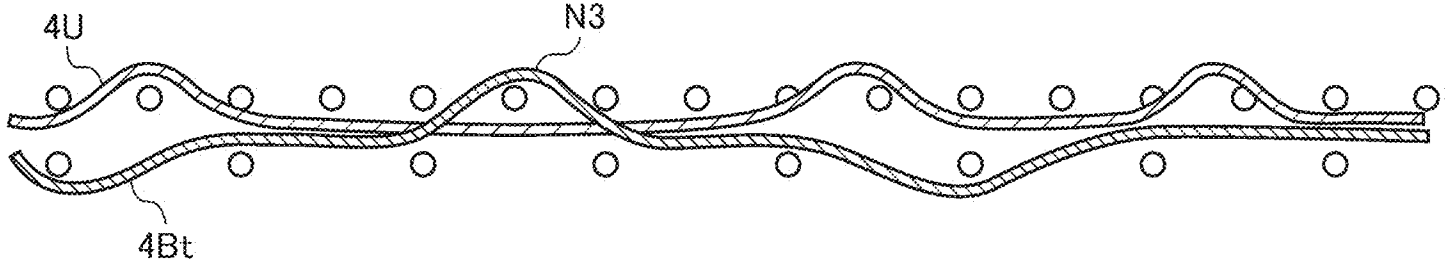
Figure 8C:
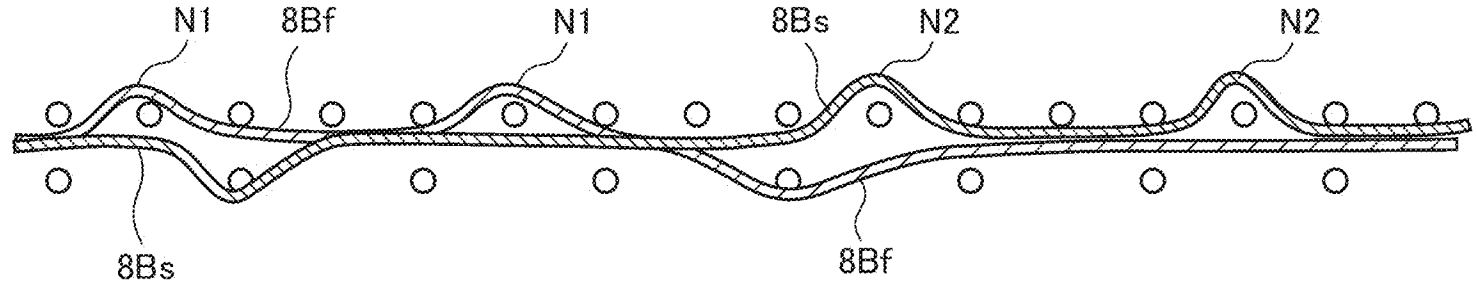

The upper surface side wefts and the lower surface side wefts shown in FIGS. 8A to 8C are arranged in the same manner. FIG. 8A shows a form in which a pair formed by the upper surface side warp 3U and the lower surface side warp 3L is interwoven with the upper and lower surface side wefts. As shown in FIG. 8A, the upper surface side warp 3U is interwoven with the upper surface side weft (1'U to 16'U) alternately in a ratio of one weft above and three wefts below the upper surface side warp 3U, passes above the upper surface side wefts (4'U, 8'U, 12'U, and 16'U) so as to form obverse surface side knuckles, and passes below the upper surface side wefts (1'U to 3'U, 5'U to 7'U, 9'U to 11'U, and 13'U to 15'U).

The other upper surface side warps (1U, 2U, and 4U to 7U) have the same weaving pattern as that of the upper surface side warp 3U, interwoven with the upper surface side weft (1'U to 16'U) alternately in a ratio of one weft above and three wefts below the upper surface side warps, and are interwoven without destroying the obverse side surface texture. The upper surface side warps (1U to 7U) are interwoven only with the upper surface side wefts (1'U to 16'U) so as to form a part of the upper surface side fabric.

The lower surface side warp 3L passes below the lower surface side wefts (5'L and 11'L) so as to form reverse surface side knuckles, respectively, and passes above the two lower surface side wefts (7'L and 9'L) and the four lower surface side wefts (1'L, 3'L, 13'L, and 15'L) between the respective reverse surface side knuckles.

The other lower surface side warps (1L, 2L, and 5L to 7L) have the same weaving pattern as that of the lower surface side warp 3L, each form two reverse surface side knuckles, and are woven passing above two lower surface side wefts and four lower surface side wefts between the reverse surface side knuckles. As described, the lower surface side warps (1L to 3L and 5L to 7L) are interwoven only with the lower surface side wefts (1'L, 3'L, 5'L, 7'L, 9'L, 11'L, 13'L, and 15'L) so as to form a part of the lower surface side fabric.

FIG. 8B shows a form in which a pair formed by the upper surface side warp 4U and the third binding warp 4Bt is interwoven with the upper and lower surface side wefts. The upper surface side warp 4U and the third binding warp 4Bt form a pair facing each other vertically and intersect with each other due to the binding by the third binding warp 4Bt.

The upper surface side warp 4U passes above the upper surface side wefts (2'U, 10'U, and 14'U) so as to form obverse surface side knuckles, respectively, and passes below the upper surface side wefts (1'U, 3'U to 9'U, 11'U to 13'U, 15'U, and 16'U).

The third binding warp 4Bt passes below the lower surface side wefts (1'L and 11'L) so as to form reverse surface side knuckles and forms a knuckle N3 passing above the upper surface side weft 6'U. The third binding warp 4Bt passes above the four lower surface side wefts (3'L, 5'L, 7'L, and 9'L) between the respective reverse surface side knuckles and above the two lower surface side wefts (13'L and 15'L). The third binding warp 4Bt is interwoven with the lower surface side fabric in the same weaving pattern as that of the lower surface side warps (1L to 3L and 5L to 7L) and is interwoven without destroying the reverse surface texture.

At the position where the third binding warp 4Bt forms a knuckle N3 on the obverse surface side, the upper surface side warp 4U does not form a knuckle on the obverse surface side after passing below the upper surface side weft 6'U and acts as an upper surface side collapsing yarn 4U that collapses a part of the upper surface side obverse surface texture.

The upper surface side warp 4U and the third binding warp 4Bt complement each other in the obverse surface texture of the upper surface side fabric, thereby forming the same obverse surface texture as that of the upper surface side warps (1U to 3U and 5U to 7U) other than the upper surface side collapsing yarn (upper surface side warp 4U) and forming the same number of knuckles arranged at the same intervals as those of the upper surface side warps (1U to 3U and 5U to 7U) other than the upper surface side collapsing yarn (upper surface side warp 4U) in the upper surface side obverse surface texture. This prevents the third binding warp 4Bt from lowering the surface properties of the upper surface side fabric. Further, by using a pair formed by the upper surface side collapsing yarn 4U, which is interwoven only with the upper surface side wefts, and the third binding warp 4Bt for the binding, a decrease in the surface properties can be suppressed compared to when binding warps are vertically provided.

FIG. 8C shows a form in which a pair formed by the first binding warp 8Bf and the second binding warp 8Bs is interwoven with the upper and lower surface side wefts. The first binding warp 8Bf and the second binding warp 8Bs form a pair facing each other vertically and intersect with each other due to binding.

The first binding warp 8Bf passes above the upper surface side wefts (2'U and 6'U) so as to form two knuckles N1 and passes below the remaining upper surface side wefts (1'U, 3'U to 5'U, and 7'U to 16'U). The first binding warp 8Bf passes below the lower surface side weft 9'L so as to form a knuckle and passes above the remaining lower surface side wefts (1'L, 3'L, 5'L, 7'L, 11'L, 13'L, and 15'L).

The second binding warp 8Bs passes above the upper surface side wefts (10'U and 14'U) so as to form two knuckles N2 and passes below the remaining upper surface side wefts (1'U to 9'U, 11'U to 13'U, 15'U, and 16'U). The second binding warp 8Bs passes below the lower surface side weft (3'L) so as to form a knuckle and passes above the remaining lower surface side wefts (1'L, 5'L, 7'L, 9'L, 11'L, 13'L, and 15'L).

In this manner, the first binding warp 8Bf and the second binding warp 8Bs complement each other in the obverse surface texture of the upper surface side fabric, thereby forming the same obverse surface texture as that of the upper surface side warps (1U to 3U and 5U to 7U) and forming the same number of knuckles arranged at the same intervals as those of the upper surface side warps (1U to 3U and 5U to 7U) in the upper surface side obverse surface texture. Further, the first binding warp 8Bf and the second binding warp 8Bs complement each other in the reverse surface texture of the lower surface side fabric, thereby forming knuckles at constant intervals on the lower surface side fabric and being interwoven without destroying the reverse surface texture.

In the weave repeat, the pair formed by the first binding warp 8Bf and the second binding warp 8Bs complement each other while the pair formed by the third binding warp 4Bt and the upper surface side collapsing yarn 4U complement each other. Thereby, the pair formed by the first binding warp 8Bf and the second binding warp 8Bs and the pair formed by the third binding warp 4Bt and the upper surface side collapsing yarn 4U form the same obverse surface texture for the upper surface side wefts (1'U to 16'U). The pair formed by the first binding warp 8Bf and second binding warp 8Bs forms obverse surface texture in which knuckles are each formed for every three upper surface side wefts (1'U to 16'U) skipped on the obverse surface side. The pair formed by the third binding warp 4Bt and the upper surface side collapsing yarn 4U also forms obverse surface texture in which knuckles are each formed for every three upper surface side wefts (1'U to 16'U) skipped on the obverse surface side. In this manner, the pair formed by the first binding warp 8Bf and the second binding warp 8Bs and the pair formed by the third binding warp 4Bt and the upper surface side collapsing yarn 4U form common obverse surface texture on the obverse surface side, thereby suppressing a decrease in the surface properties of the upper surface side fabric caused due to binding.

The pair formed by the first binding warp 8Bf and the second binding warp 8Bs is not adjacent to the pair formed by the third binding warp 4Bt and the upper surface side collapsing yarn 4U. In the weave repeat, the number of the first binding warp 8Bf, the second binding warp 8Bs, and the third binding warp 4Bt combined is less than half the number of all the warps. The number of all the warps forming the weave repeat is a multiple of four.

Fifth Embodiment

Figure 9:
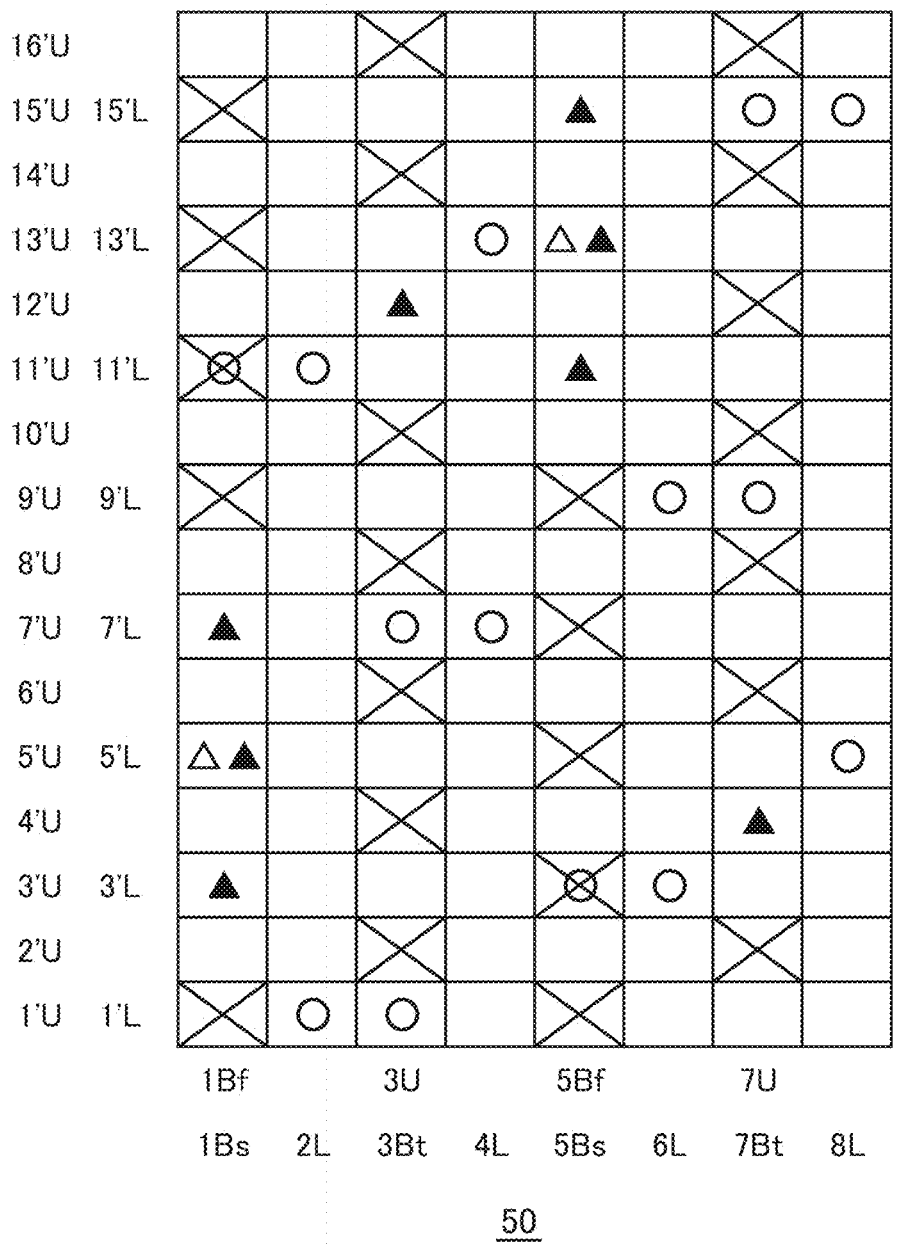
FIG. 9 is a design diagram showing a weave repeat of an industrial fabric according to the fifth embodiment.

FIG. 9 is a design diagram showing a weave repeat of an industrial fabric 50 according to the fifth embodiment. FIG. 10 is a cross-sectional view in the warp direction along warps in the design diagram shown in FIG. 9.

In an industrial fabric 50 according to the fifth embodiment shown in FIG. 9, an upper surface side fabric formed including upper surface side warps (3U and 78U) and upper surface side wefts (1'U to 16'U) and a lower surface side fabric composed of lower surface side warps (2L, 4L, 6L, and 8L) and lower surface side wefts (1'L, 3'L, 5'L, 7'L, 9'L, 11'L, 13'L, and 15'L) are bound to each other by the first binding warps (1Bf and 5Bf), the second binding warps (1Bs and 5Bs), and the third binding warps (3Bt and 7Bt). The upper surface side wefts (1'U to 16'U) form a part of the upper surface side fabric. The lower surface side wefts (1'L, 3'L, 5'L, 7'L, 9'L, 11'L, 13'L, and 15'L) form a part of the lower surface side fabric. The first binding warps (1Bf and 5Bf), the second binding warps (1Bs and 5Bs), and the third binding warps (3Bt and 7Bt) bind the upper surface side fabric and the lower surface side fabric and each form a part of the upper surface side fabric and a part of the lower surface side fabric. Since the number of lower surface side warps is twice the number of upper surface side warps, the density of upper surface side warps becomes small, allowing more upper surface side wefts to be woven compared to the normal ratio of upper surface side warps to lower surface side warps (1:1).

Figures 10A, 10B, 10C:
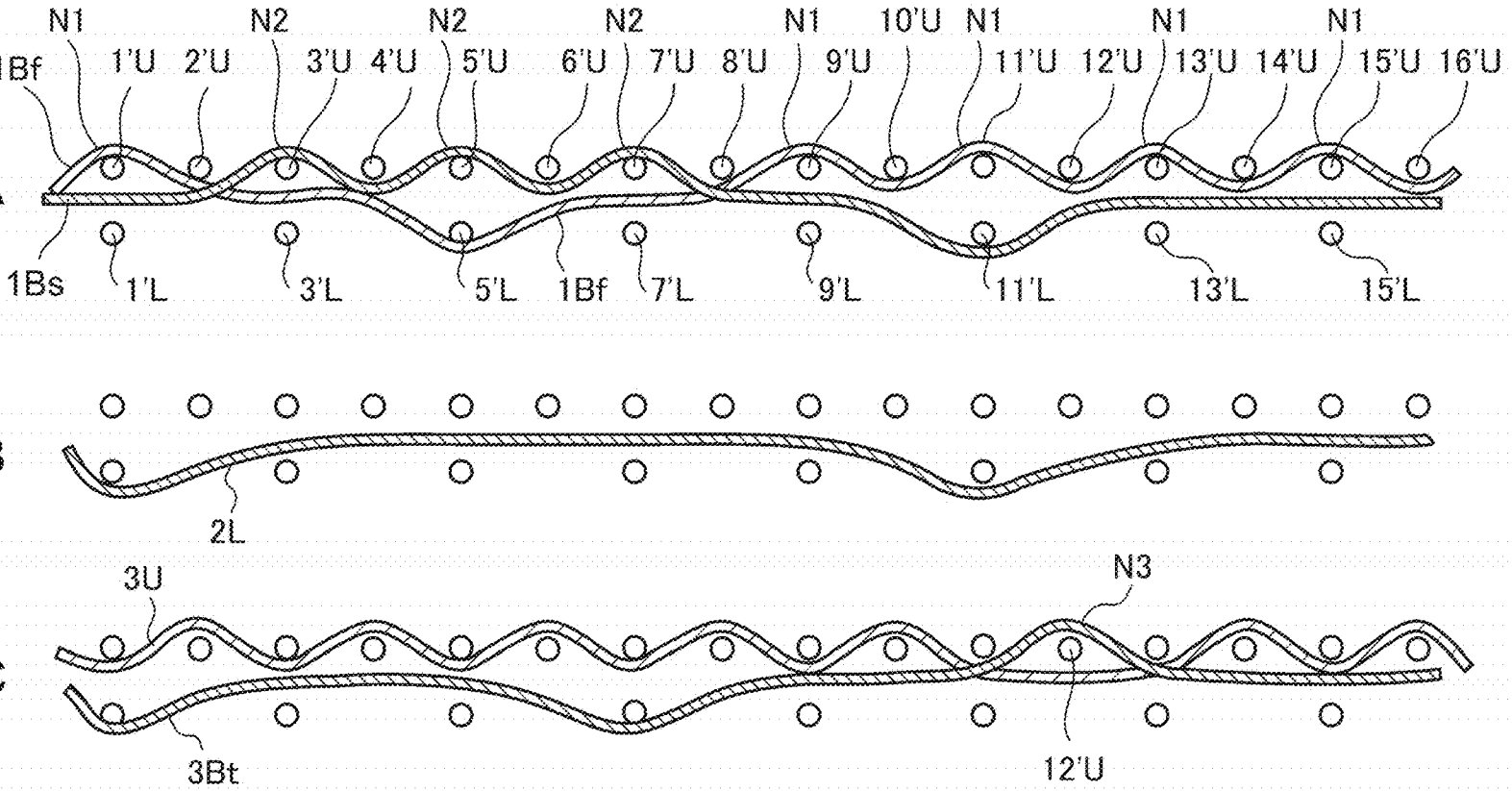
FIGS. 10A, 10B, and 10C are cross-sectional views in the warp direction along warps in the design diagram shown in FIG. 9.

FIG. 10A shows a form in which a pair formed by the first binding warp 1Bf and the second binding warp 1Bs is interwoven with the upper and lower surface side wefts. The upper surface side wefts and the lower surface side wefts shown in FIGS. 10A to 10C are arranged in the same manner. The first binding warp 1Bf and the second binding warp 1Bs form a pair facing each other vertically and intersect with each other due to binding.

The first binding warp 1Bf passes above the upper surface side wefts (1'U, 9'U, 11'U, 13'U, and 15'U) so as to form five knuckles N1 and passes below the remaining upper surface side wefts (2'U to 8'U, 10'U, 12'U, 14'U, and 16'U). The first binding warp 1Bf passes below the lower surface side weft 5'L so as to form a knuckle and passes above the lower surface side wefts (1'L, 3'L, 7'L, 9'L, 11'L, 13'L, and 15'L).

The second binding warp 1Bs passes above the upper surface side wefts (3'U, 5'U, and 7'U) so as to form three knuckles N2 and passes below the remaining upper surface side wefts (1'U, 2'U, 4'U, 6'U, and 8'U to 16'U). The second binding warp 1Bs passes below the lower surface side weft 11'L so as to form a knuckle and passes above the lower surface side wefts (1'L, 3'L, 5'L, 7'L, 9'L, 13'L, and 15'L).

As described, the pair formed by the first binding warp 1Bf and the second binding warp 1Bs complement each other in the obverse surface texture of the upper surface side fabric, thereby becoming interwoven alternately one by one with the upper surface side wefts and being interwoven without destroying the obverse surface texture. Further, the first binding warp 1Bf and the second binding warp 1Bs complement each other in the reverse surface texture of the lower surface side fabric, thereby forming knuckles at constant intervals on the lower surface side fabric and being interwoven without destroying the reverse surface texture. Although the binding position of the first binding warp 5Bf and the second binding warp 5Bs is shifted in the warp direction from that of the first binding warp 1Bf and the second binding warp 1Bs, the first binding warp 5Bf and the second binding warp 5Bs have the same weave pattern and thus exhibit the same function.

FIG. 10B shows a form in which the lower surface side warp 2L is interwoven with the lower surface side wefts. The lower surface side warp 2L passes below the lower surface side wefts (1'L and 11'L) so as to form reverse surface side knuckles, respectively, and passes above the four lower surface side wefts (3'L, 5'L, 7'L, and 9'L) and the two lower surface side wefts (13'L and 15'L) between the respective reverse surface side knuckles.

The lower surface side warps (4L, 6L, and 8L) have the same weaving pattern as that of the lower surface side warp 2L, form two reverse surface side knuckles, and pass above four lower surface side wefts and two lower surface side wefts between the reverse surface side knuckles. As described, the lower surface side warps (2L, 4L, 6L, and 8L) are interwoven only with the lower surface side wefts (1'L, 3'L, 5'L, 7'L, 9'L, 11'L, 13'L, and 15'L) so as to form a part of the lower surface side fabric.

FIG. 10C shows a form in which a pair formed by the upper surface side warp 3U and the third binding warp 3Bt is interwoven with the upper and lower surface side wefts. The upper surface side warp 3U and the third binding warp 3Bt form a pair facing each other vertically and intersect with each other due to the binding by the third binding warp 3Bt.

The upper surface side warp 3U passes above the upper surface side wefts (2'U, 4'U, 6'U, 8'U, 10'U, 14'U, and 16'U) so as to form obverse surface side knuckles, respectively, and passes below the upper surface side wefts (1'U, 3'U, 5'U, 7'U, 9'U, 11'U to 13'U, and 15'U).

The third binding warp 3Bt passes below the lower surface side wefts (1'L and 7'L) so as to form knuckles and forms a knuckle N3 passing above the upper surface side weft 12'U. The third binding warp 3Bt passes above the two lower surface side wefts (3'L and 5'L) and the four lower surface side wefts (9'L, 11'L, 13'L, and 15'L) between the respective reverse surface side knuckles of the lower surface side wefts (1'L and 7'L). The third binding warp 3Bt is interwoven with the lower surface side fabric in the same weaving pattern as that of the lower surface side warps (2L, 4L, 6L, and 8L) and is interwoven without destroying the reverse surface texture.

With respect to the upper surface side fabric, the third binding warp 3Bt passes below the upper surface side wefts (1'U to 11'L and 13'U to 16'L) and passes above the upper surface side weft 12'U for binding so as to form only one knuckle N3 on the obverse surface side.

At the position where the third binding warp 3Bt forms a knuckle N3 on the obverse surface side, the upper surface side warp 3U does not form a knuckle on the obverse surface side after passing below the upper surface side weft 12'U and acts as an upper surface side collapsing yarn 3U that collapses a part of the upper surface side obverse surface texture.

The upper surface side warp 3U and the third binding warp 3Bt complement each other in the obverse surface texture of the upper surface side fabric, thereby forming knuckles at constant intervals on the obverse structure of the upper surface side fabric. This prevents the third binding warp 3Bt from lowering the surface properties of the upper surface side fabric. Further, by using the pair formed by the upper surface side collapsing yarn 3U, which is interwoven only with the upper surface side wefts, and the third binding warp 3Bt for the binding, a decrease in the surface properties can be suppressed compared to when binding warps are vertically provided. Although the binding position of the upper surface side warp 7U and the third binding warp 7Bt is shifted in the warp direction from that of the upper surface side warp 3U and the third binding warp 3Bt, the upper surface side warp 7U and the third binding warp 7Bt have the same weave pattern and thus exhibit the same function.

In the weave repeat, the pair formed by the first binding warps (1Bf and 5Bf) and the second binding warps (1Bs and 5Bs) complement each other while the pair formed by the third binding warps (3Bt and 7Bt) and the upper surface side collapsing yarns (3U and 7U) complement each other. Thereby, the pair formed by the first binding warps (1Bf and 5Bf) and the second binding warps (1Bs and 5Bs) and the pair formed by the third binding warps (3Bt and 7Bt) and the upper surface side collapsing yarns (3U and 7U) form the same obverse surface texture for the upper surface side wefts (1'U to 16'U). The pair formed by the first binding warps (1Bf and 5Bf) and the second binding warps (1Bs and 5Bs) forms an obverse surface texture in which knuckles are formed for every other upper surface side weft (1'U to 16'U) on the obverse surface side. The pair formed by the third binding warps (3Bt and 7Bt) and the upper surface side collapsing yarns (3U and 7U) also forms an obverse surface texture in which knuckles are formed for every other upper surface side weft (1'U to 16'U) on the obverse surface side. In this manner, the pair formed by the first binding warps (1Bf and 5Bf) and the second binding warps (1Bs and 5Bs) and the pair formed by the third binding warps (3Bt and 7Bt) and the upper surface side collapsing yarns (3U and 7U) form common obverse surface texture on the obverse surface side, thereby suppressing a decrease in the surface properties of the upper surface side fabric caused due to binding.

The pair formed by the first binding warps (1Bf and 5Bf) and the second binding warps (1Bs and 5Bs) is adjacent to the pair formed by the third binding warps (3Bt and 7Bt) and the upper surface side collapsing yarns (3U and 7U). The number of all the warps forming the weave repeat is a multiple of four.

In the weave repeat, the number of the first binding warps (1Bf and 5Bf), the second binding warps (1Bs and 5Bs), and the third binding warps (3Bt and 7Bt) combined is half the number of all the warps (1Bf, 1Bs, 2L, 3U, 3Bt, 4L, 5Bf, 5Bs, 6L, 7U, 7Bt, and 8L) or more. Thereby, the binding force can be strengthened to suppress internal friction between the upper surface side fabric and the lower surface side fabric.

The number (five) of knuckles formed by the first binding warp 1Bf in the upper surface side fabric is different from the number (three) of knuckles formed by the second binding warp 1Bs in the upper surface side fabric. Thus, the texture of the upper side binding yarn and the texture of the lower side binding yarn are different from each other. In general, the intersection of the two binding yarns tends to have (i) decreased dewaterability and (ii) locally increased draw-in of the upper surface side weft. Therefore, when the intersections are regularly aligned, marks (weft marks, regular diagonal marks) are more likely to occur in those areas. In particular, when the binding yarns have the same texture, the above defects are likely to be caused due to the occurrence of the regularity. Therefore, making the two binding yarns to have different texture as in the industrial fabric 50 reduces the regularity in the alignment of the intersection of the two binding yarns. As a result, the occurrence of marks is suppressed.

The warps interwoven into the upper side fabric is composed only of the pair formed by the first binding warps (1Bf and 5Bf) and the second binding warps (1Bs and 5Bs) and the pair formed by the third binding warps (3Bt and 7Bt) and the upper surface side collapsing yarns (3U and 7U), each of which is composed of warp rows that are bound together. In this manner, by increasing the number of binding yarns, the binding force between the upper and lower surface side fabrics can be increased, and internal wear can be suppressed.

Sixth Embodiment

Figure 11:
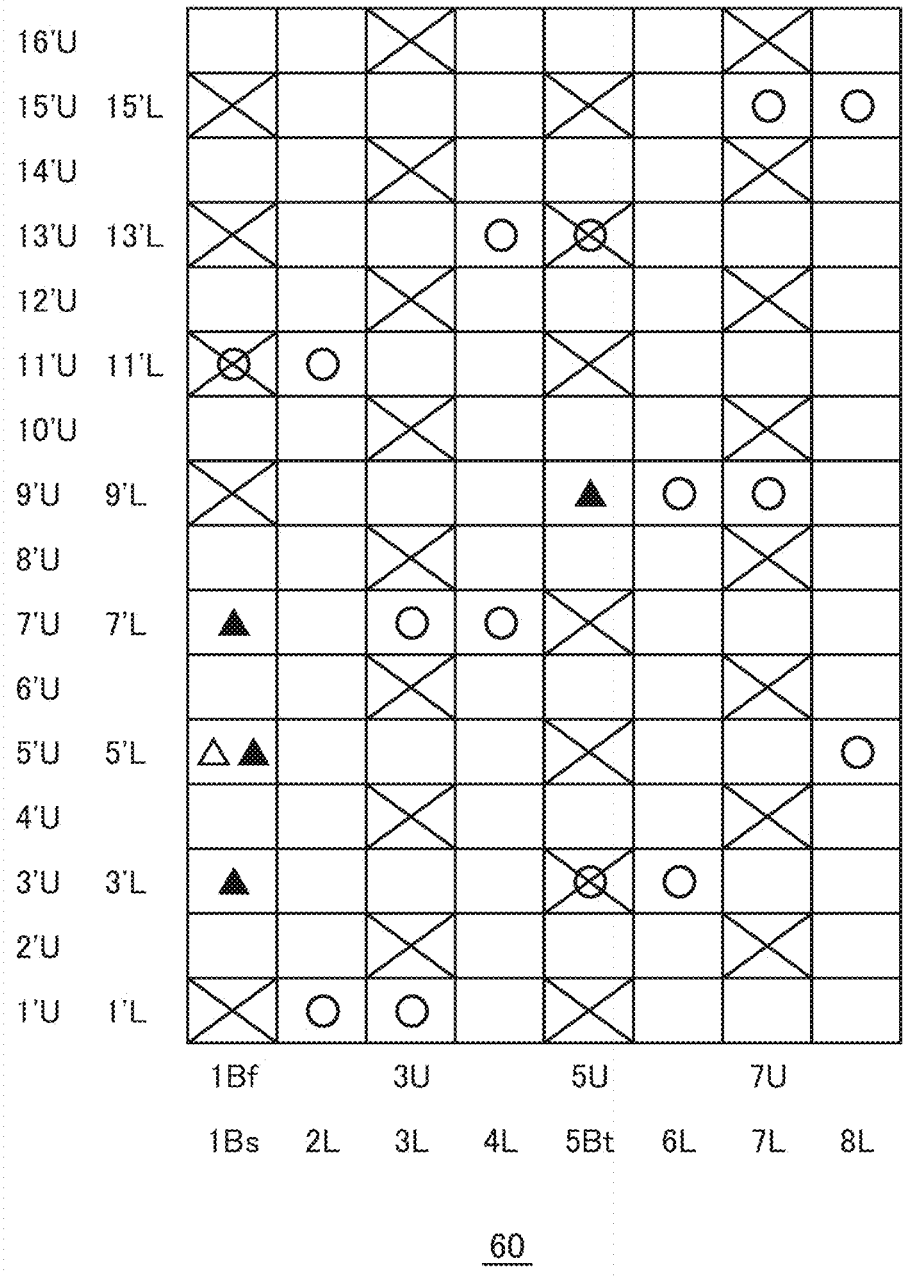
FIG. 11 is a design diagram showing a weave repeat of an industrial fabric according to the sixth embodiment.

FIG. 11 is a design diagram showing a weave repeat of an industrial fabric 60 according to the sixth embodiment. FIG. 12 is a cross-sectional view in the warp direction along warps in the design diagram shown in FIG. 11.

In the industrial fabric 60 according to the sixth embodiment shown in FIG. 11, an upper surface side fabric formed including upper surface side warps (30, 50, and 7U) and upper surface side wefts (1'U to 16'U) and a lower surface side fabric composed of lower surface side warps (2L to 4L and 6L to 8L) and lower surface side wefts (1'L, 3'L, 5'L, 7'L, 9'L, 11'L, 13'L, and 15'L) are bound to each other by the first binding warp 1Bf, the second binding warp 1Bs, and the third binding warp 5Bt. The upper surface side wefts (1'U to 16'U) form a part of the upper surface side fabric. The lower surface side wefts (1'L, 3'L, 5'L, 7'L, 9'L, 11'L, 13'L, and 15'L) form a part of the lower surface side fabric. The first binding warp 1Bf, the second binding warp 1Bs, and the third binding warp 5Bt bind the upper surface side fabric and the lower surface side fabric and each form a part of the upper surface side fabric and a part of the lower surface side fabric.

Figures 12A, 12B, 12C, 12D:
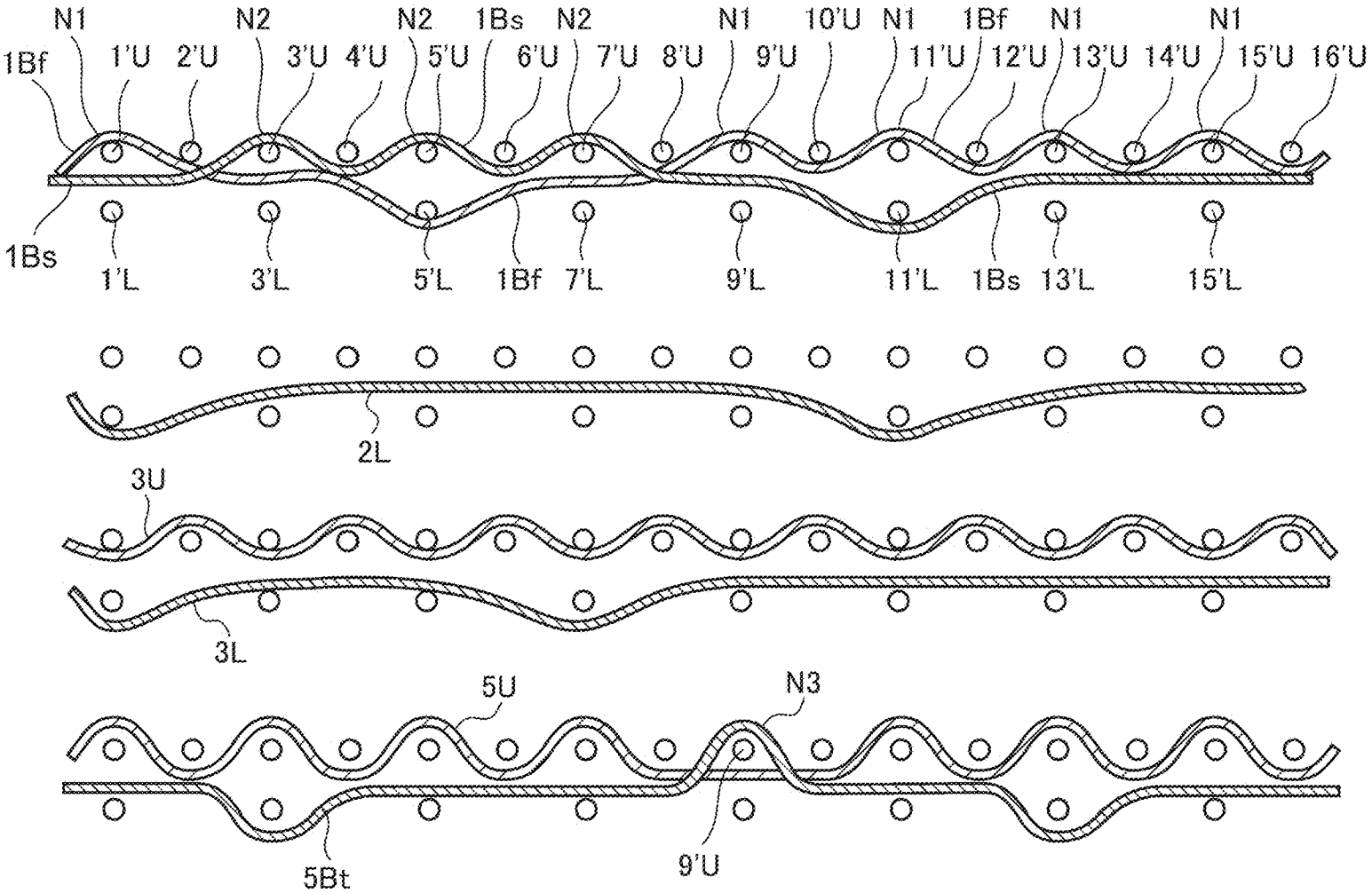
FIGS. 12A, 12B, 12C, and 12D are cross-sectional views in the warp direction along warps in the design diagram shown in FIG. 11.

FIG. 12A shows a form in which a pair formed by the first binding warp 1Bf and the second binding warp 1Bs is interwoven with the upper and lower surface side wefts. The upper surface side wefts and the lower surface side wefts shown in FIGS. 2A to 2D are arranged in the same manner. The first binding warp 1Bf and the second binding warp 1Bs form a pair facing each other vertically and intersect with each other due to binding.

The first binding warp 1Bf passes above the upper surface side wefts (1'U, 9'U, 11'U, 13'U, and 15'U) so as to form five knuckles N1 and passes below the remaining upper surface side wefts (2'U to 8'U, 10'U, 12'U, 14'U, and 16'U). The first binding warp 1Bf passes below the lower surface side weft 5'L so as to form a knuckle and passes above the lower surface side wefts (1'L, 3'L, 7'L, 9'L, 11'L, 13'L, and 15'L).

The second binding warp 1Bs passes above the upper surface side wefts (3'U, 5'U, and 7'U) so as to form three knuckles N2 and passes below the remaining upper surface side wefts (1'U, 2'U, 4'U, 6'U, and 8'U to 16'U). The second binding warp 1Bs passes below the lower surface side weft 11'L so as to form a knuckle and passes above the lower surface side wefts (1'L, 3'L, 5'L, 7'L, 9'L, 13'L, and 15' L).

As described, the pair formed by the first binding warp 1Bf and the second binding warp 1Bs complement each other in the obverse surface texture of the upper surface side fabric, thereby becoming interwoven alternately one by one with the upper surface side wefts and being interwoven without destroying the obverse surface texture. Further, the first binding warp 1Bf and the second binding warp 1Bs complement each other in the reverse surface texture of the lower surface side fabric, thereby forming knuckles at constant intervals on the lower surface side fabric and being interwoven without destroying the reverse surface texture.

FIG. 12B shows a form in which the lower surface side warp 2L is interwoven with the lower surface side wefts. The lower surface side warp 2L passes below the lower surface side wefts (1'L and 11'L) so as to form reverse surface side knuckles, respectively, and passes above the four lower surface side wefts (3'L, 5'L, 7'L, and 9'L) and the two lower surface side wefts (13'L and 15'L) between the respective reverse surface side knuckles.

The lower surface side warps (4L, 6L, and 8L) have the same weaving pattern as that of the lower surface side warp 2L, form two reverse surface side knuckles, and pass above four lower surface side wefts and two lower surface side wefts between the reverse surface side knuckles. As described, the lower surface side warps (2L, 4L, 6L, 8L) are interwoven only with the lower surface side wefts (1'L, 3'L, 5'L, 7'L, 9'L, 11'L, 13'L, and 15'L) so as to form a part of the lower surface side fabric.

FIG. 12C shows a form in which a pair formed by the upper surface side warp 3U and the lower surface side warp 3L is interwoven with the upper and lower surface side wefts. As shown in FIG. 12C, the upper surface side warp 3U is woven alternately above and below the upper surface side wefts (1'U to 16'U) one by one, passes above the upper surface side wefts (2'U, 4'U, 6'U, 8'U, 10'U, 12'U, 14'U, and 16'U) so as to form obverse surface side knuckles, and passes below the upper surface side wefts (1'U, 3'U, 5'U, 7'U, 9'U, 11'U, 13'U, and 15'U).

Another upper surface side warp 7U has the same weaving pattern as that of the upper surface side warp 3U, interwoven with the upper surface side weft (1'U to 16'U) above and below the upper surface side warps one by one, and is interwoven without destroying the obverse surface texture. The upper surface side warps (3U and 7U) are interwoven only with the upper surface side wefts (1'U to 16'U) so as to form a part of the upper surface side fabric.

The lower surface side warp 3L passes below the lower surface side wefts (1'L and 7'L) so as to form reverse surface side knuckles, respectively, and passes above the two lower surface side wefts (3'L and 5'L) and the four lower surface side wefts (9'L, 11'L, 13'L, and 15'L) between the respective reverse surface side knuckles.

Another lower surface side warp 7L also has the same weaving pattern as that of the lower surface side warp 3L, forms two reverse surface side knuckles, and is woven passing above two lower surface side wefts and four lower surface side wefts between the reverse surface side knuckles.

As described, the lower surface side warps (3L and 7L) are interwoven only with the lower surface side wefts (1'L, 3'L, 5'L, 7'L, 9'L, 11'L, 13'L, and 15'L) so as to form a part of the lower surface side fabric.

FIG. 12D shows a form in which a pair formed by the upper surface side warp 5U and the third binding warp 5Bt is interwoven with the upper and lower surface side wefts. The upper surface side warp 5U and the third binding warp 5Bt form a pair facing each other vertically and intersect with each other due to the binding by the third binding warp 5Bt.

The upper surface side warp 50 passes above the upper surface side wefts (1'U, 3'U, 5'U, 7'U, 11'U, 13'U, and 15'U) so as to form obverse surface side knuckles, respectively, and passes below the upper surface side wefts (2'U, 4'U, 6'U, 8'U to 10'U, 12'U, 14'U, and 16'U).

The third binding warp 5Bt passes below the lower surface side wefts (3'L and 13'L) so as to form knuckles and forms a knuckle N3 passing above the upper surface side weft 9'U. The third binding warp 5Bt passes above the two lower surface side wefts (1'L and 15'L) and the four lower surface side wefts (5'L, 7'L, 9'L, and 11'L) between the respective reverse surface side knuckles of the lower surface side wefts (3'L and 13'L). The third binding warp 5Bt is interwoven with the lower surface side fabric in the same weaving pattern as that of the lower surface side warps (2L to 4L and 6L to 8L) and is interwoven without destroying the reverse surface texture.

With respect to the upper surface side fabric, the third binding warp 5Bt passes below the upper surface side wefts (1'U to 8'L and 10'U to 16'L) and passes above the upper surface side weft 9'U for binding so as to form only one knuckle N3 on the obverse surface side.

At the position where the third binding warp 5Bt forms a knuckle N3 on the obverse surface side, the upper surface side warp 5U does not form a knuckle on the obverse surface side after passing below the upper surface side weft 9'U and acts as an upper surface side collapsing yarn 5U that collapses a part of the upper surface side obverse surface texture.

The upper surfaced side warp 50 and the third binding warp 5Bt complement each other in the obverse surface texture of the upper surface side fabric, thereby forming knuckles at constant intervals on the obverse structure of the upper surface side fabric. This prevents the third binding warp 5Bt from lowering the surface properties of the upper surface side fabric. Further, by using the pair formed by the upper surface side collapsing yarn 5U, which is interwoven only with the upper surface side wefts, and the third binding warp 5Bt for the binding, a decrease in the surface properties can be suppressed compared to when binding warps are vertically provided.

In the weave repeat, the pair formed by the first binding warp 1Bf and the second binding warp 1Bs complement each other while the pair formed by the third binding warp 5Bt and the upper surface side collapsing yarn 5U complement each other. Thereby, the pair formed by the first binding warp 1Bf and the second binding warp 1Bs and the pair formed by the third binding warp 5Bt and the upper surface side collapsing yarn 5U form the same obverse surface texture for the upper surface side wefts (1'U to 16'U). The pair formed by the first binding warp 1Bf and second binding warp 1Bs forms obverse surface texture in which knuckles are formed for every other upper surface side weft (1'U to 16'U) on the obverse surface side. The pair formed by the third binding warp 5Bt and the upper surface side collapsing yarn 5U also forms obverse surface texture in which knuckles are formed for every other upper surface side weft (1'U to 16'U) on the obverse surface side. In this manner, the pair formed by the first binding warp 1Bf and the second binding warp 1Bs and the pair formed by the third binding warp 5Bt and the upper surface side collapsing yarn 5U form common obverse surface texture on the obverse surface side, thereby suppressing a decrease in the surface properties of the upper surface side fabric caused due to binding.

The pair formed by the first binding warp 1Bf and the second binding warp 1Bs is not adjacent to the pair formed by the third binding warp 5Bt and the upper surface side collapsing yarn 5U. The number of all the warps forming the weave repeat is a multiple of four. In the weave repeat, the number of the first binding warp 1Bf, the second binding warp 1Bs, and the third binding warp 5Bt combined is less than half the number of all the warps.

Seventh Embodiment

Figure 13:
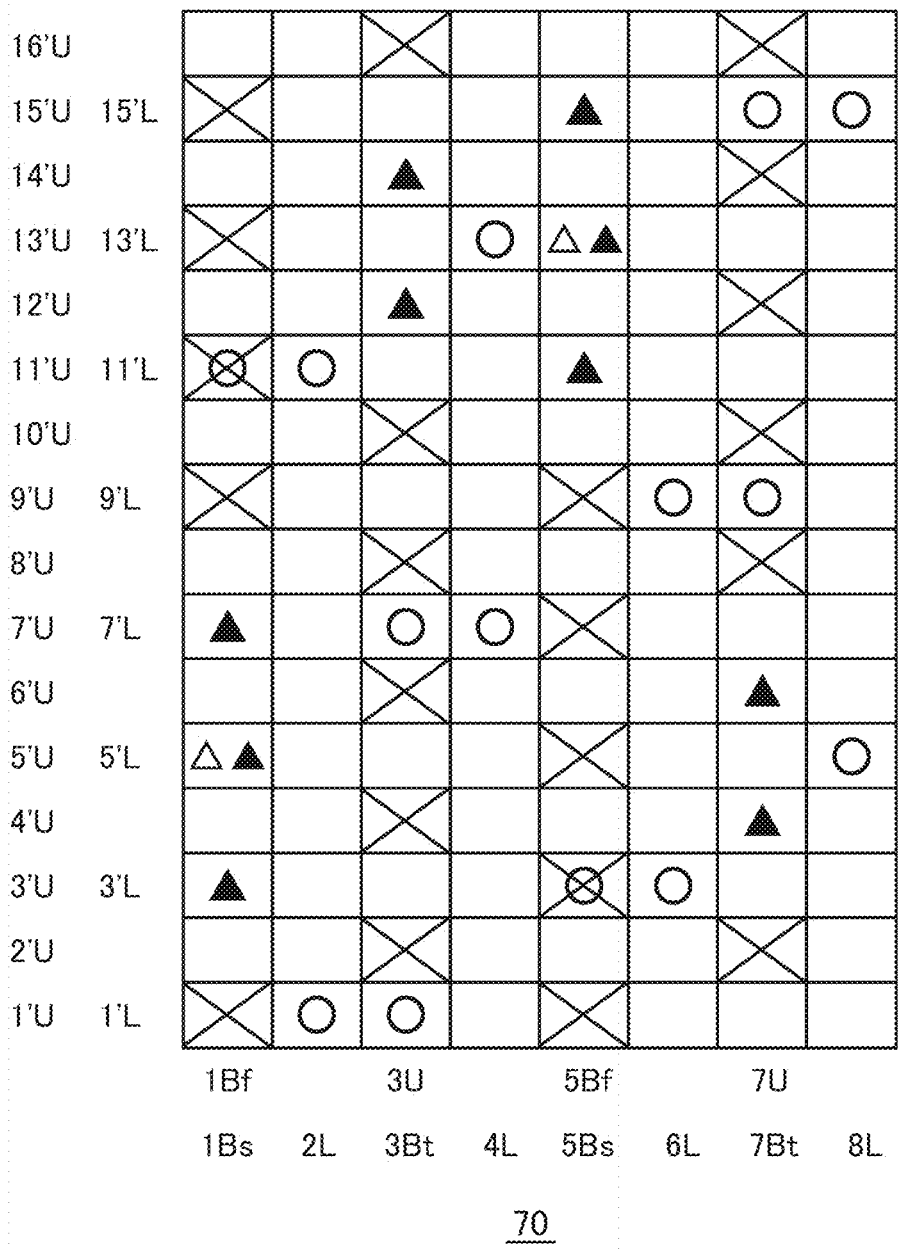
FIG. 13 is a design diagram showing a weave repeat of an industrial fabric according to the seventh embodiment.

FIG. 13 is a design diagram showing a weave repeat of an industrial fabric 70 according to the seventh embodiment. In the industrial fabric 70 according to the seventh embodiment, the number of knuckles formed by the third binding warp 3Bt on the obverse surface side of the upper surface fabric is larger than that of the industrial fabric 50 shown in FIG. 9, and the third binding warp 3Bt forms two knuckles on the obverse surface side.

Eighth Embodiment

Figure 14:
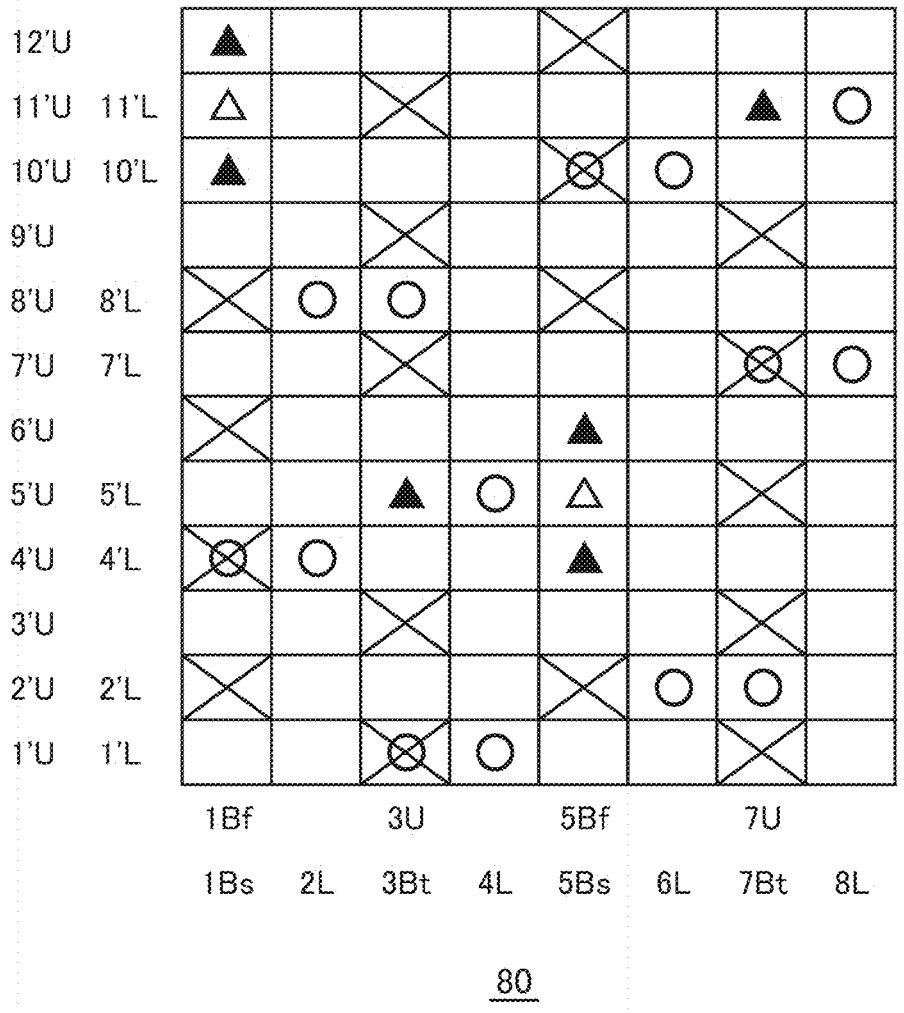
FIG. 14 is a design diagram showing a weave repeat of an industrial fabric according to the eighth embodiment.

FIG. 14 is a design diagram showing a weave repeat of an industrial fabric 80 according to the eighth embodiment. Compared to the industrial fabric 50 shown in FIG. 9, the industrial fabric 80 according to the eighth embodiment has fewer upper surface side wefts forming a weave repeat, and the arrangement of the lower surface side wefts is different. The industrial fabric 80 is formed using twelve upper surface side wefts, and the lower surface side wefts are arranged such that one upper surface side weft is skipped for every two consecutive upper surface side wefts. The ratio of the upper surface side wefts and the lower surface side wefts is 3:2, which can suppress the occurrence of curls at the widthwise (weft direction) ends of the industrial fabric 80 and improve abrasion resistance.

Ninth Embodiment

Figure 15:
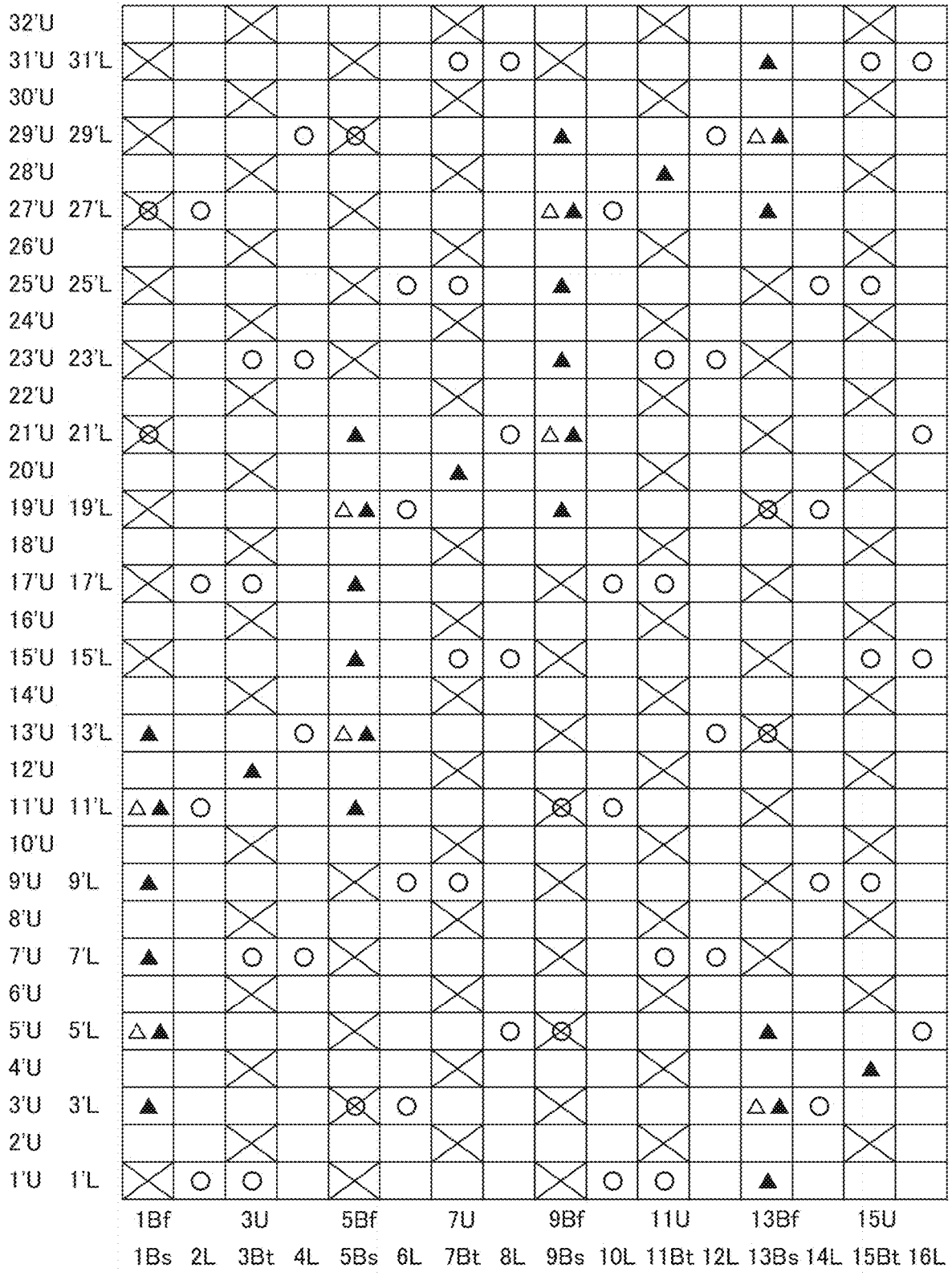
FIG. 15 is a design diagram showing a weave repeat of an industrial fabric according to the ninth embodiment.

FIG. 15 is a design diagram showing a weave repeat of an industrial fabric 90 according to the ninth embodiment. Compared to the industrial fabric 50 shown in FIG. 9, the industrial fabric 90 according to the ninth embodiment is different in that the industrial fabric 90 has a larger number of shafts and more upper surface side wefts forming a weave repeat. The industrial fabric 90 according to the ninth embodiment is formed using 16 rows of warps and 32 upper surface side wefts. By increasing the number of weft shafts, it is possible to disperse the bound parts so as to suppress the occurrence of marks and improve the smoothness of the surface and the uniformity of dewatering.

Tenth Embodiment

Figure 16:
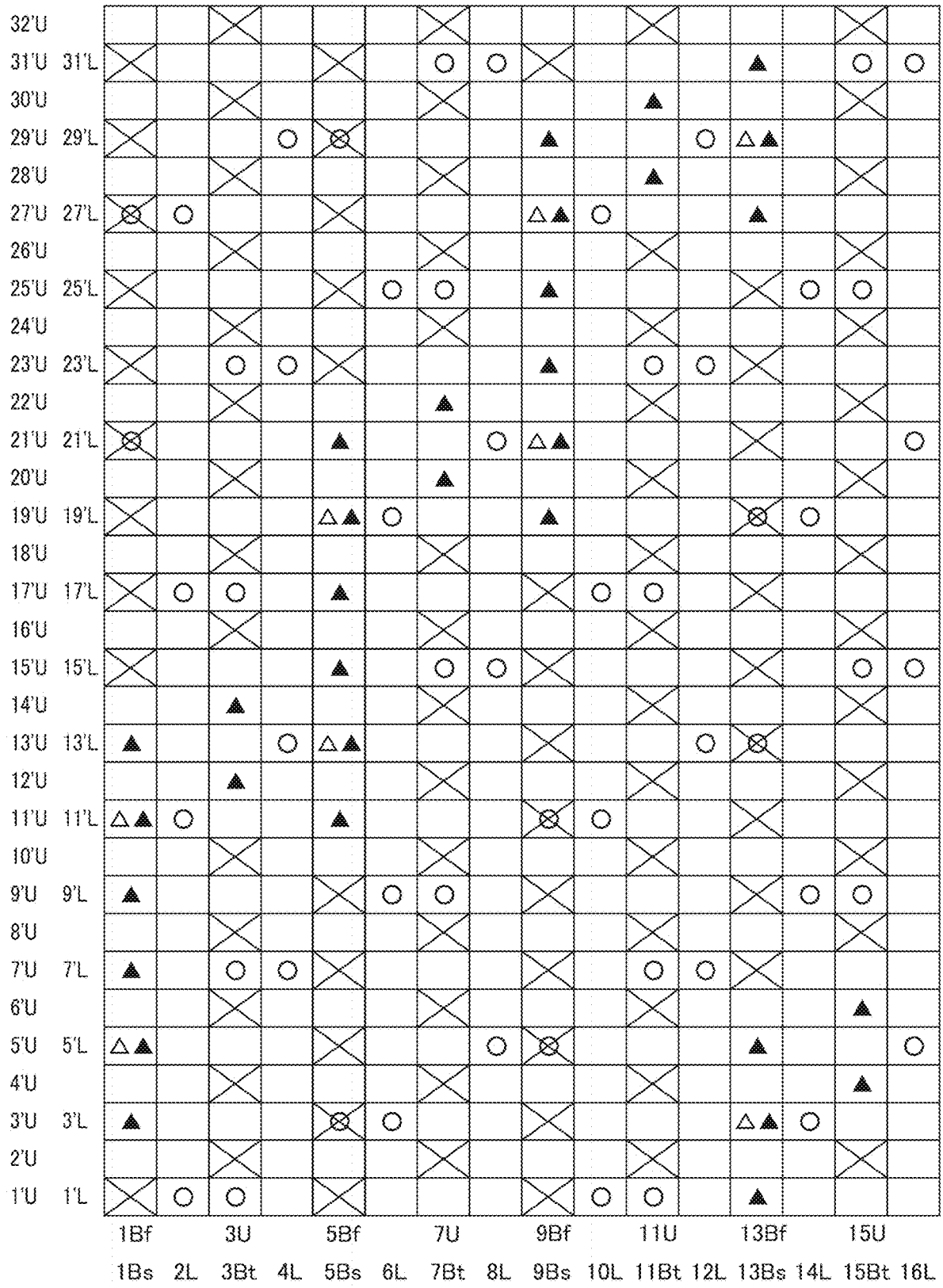
FIG. 16 is a design diagram showing a weave repeat of an industrial fabric according to the tenth embodiment.

FIG. 16 is a design diagram showing a weave repeat of an industrial fabric 100 according to the tenth embodiment. In the industrial fabric 100 according to the tenth embodiment, the number of knuckles formed by the third binding warps (3Bt, 7Bt, 11Bt, and 15Bt) on the obverse surface side of the upper surface fabric is larger than that of the industrial fabric 90 shown in FIG. 15, and the third binding warps each form two knuckles on the obverse surface side.

Eleventh Embodiment

Figure 17:
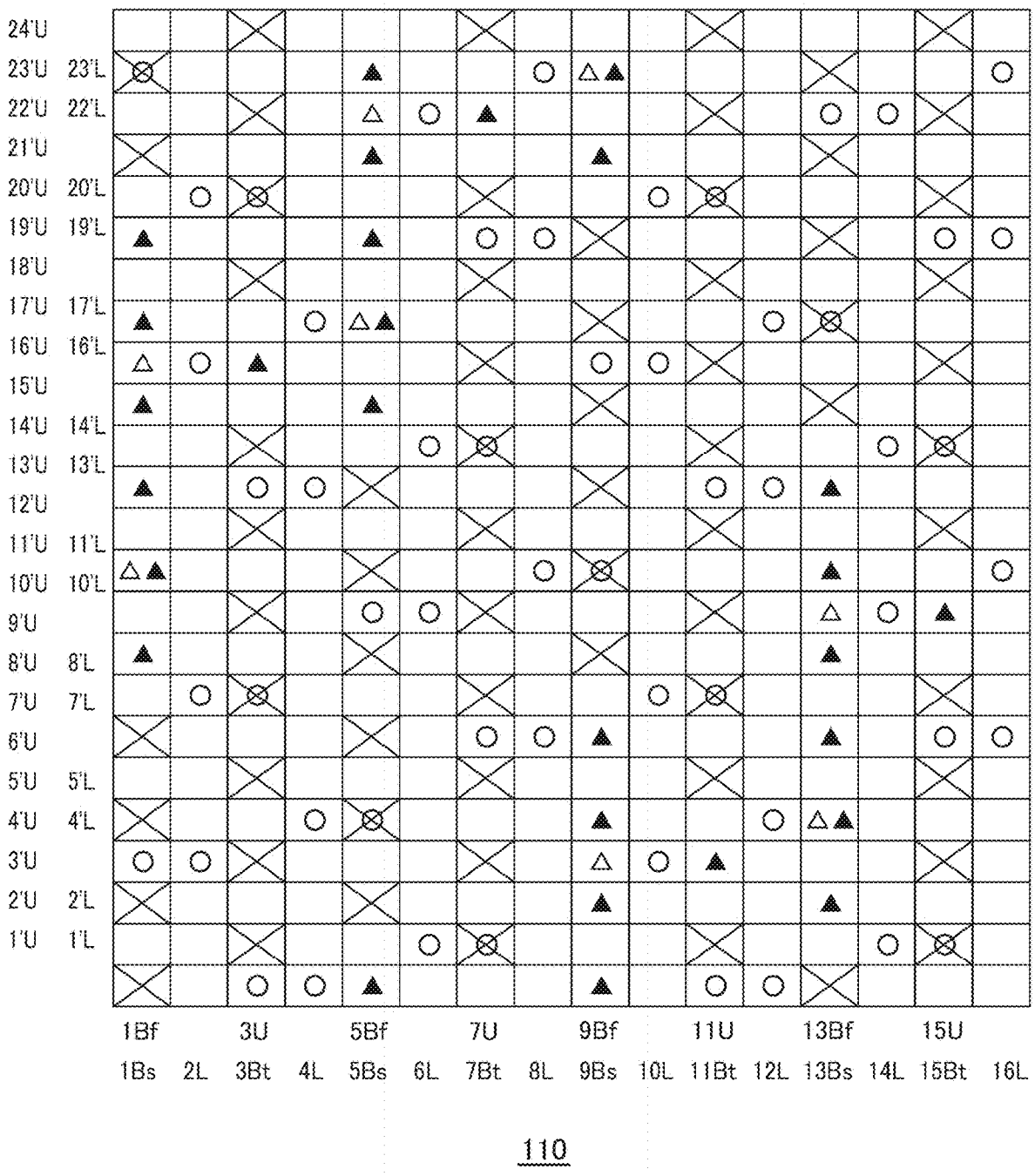
FIG. 17 is a design diagram showing a weave repeat of an industrial fabric according to the eleventh embodiment.

FIG. 17 is a design diagram showing a weave repeat of an industrial fabric 110 according to the eleventh embodiment. Compared to the industrial fabric 80 shown in FIG. 14, the industrial fabric 110 according to the eleventh embodiment is different in that the industrial fabric 110 has a larger number of shafts and more upper surface side wefts forming a weave repeat. The industrial fabric 110 according to the eleventh embodiment is formed using 16 rows of warps and 24 upper surface side wefts.

Twelfth Embodiment

FIG. 18 is a design diagram showing a weave repeat of an industrial fabric 120 according to the twelfth embodiment. In the industrial fabric 120 according to the twelfth embodiment, the number of knuckles formed by the third binding warps (3Bt, 7Bt, 11Bt, and 15Bt) on the obverse surface side of the upper surface fabric is larger than that of the industrial fabric 110 shown in FIG. 17, and the third binding warps each form two knuckles on the obverse surface side.

Thirteenth Embodiment

Figure 19:
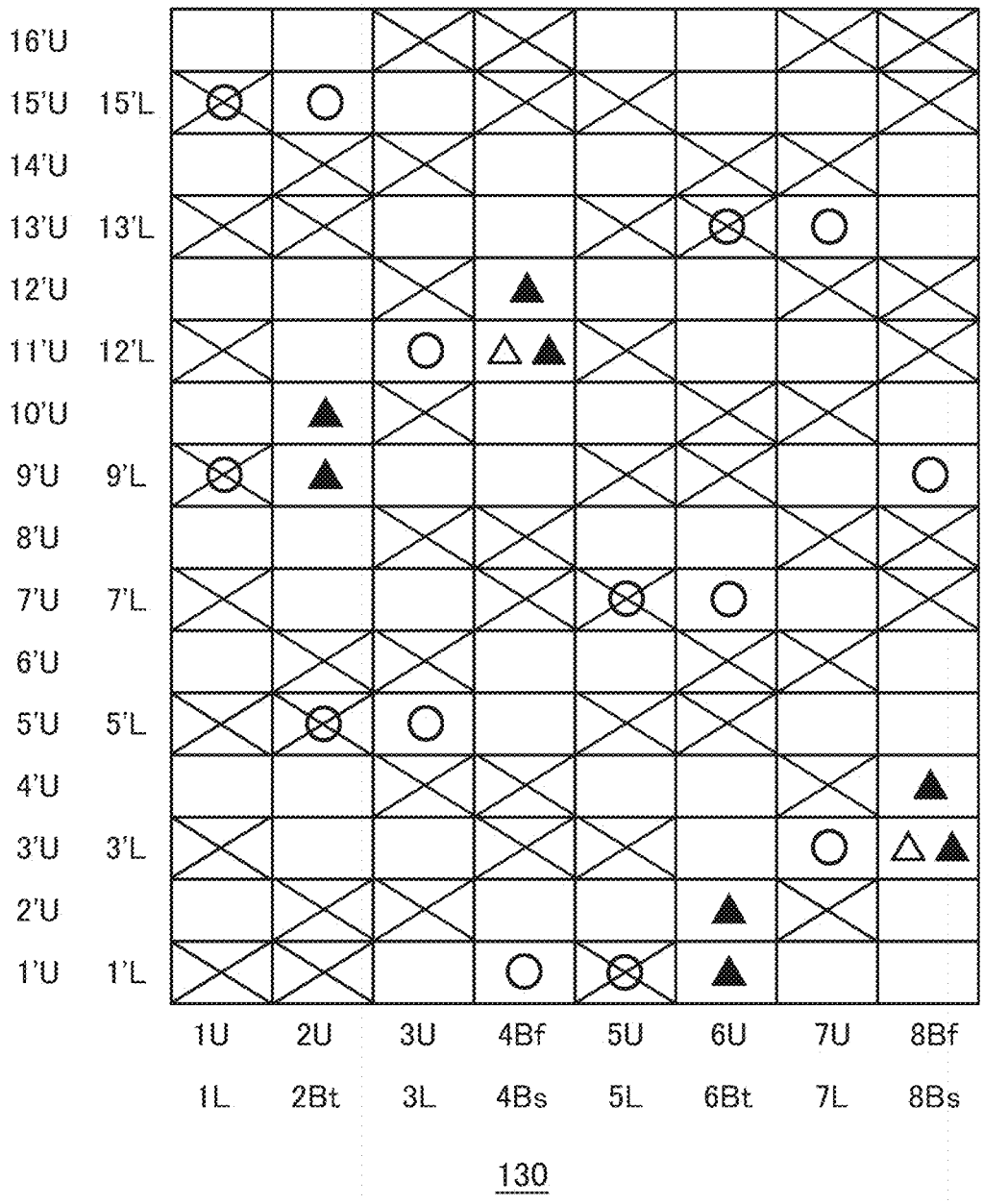
FIG. 19 is a design diagram showing a weave repeat of an industrial fabric according to the thirteenth embodiment.

FIG. 19 is a design diagram showing a weave repeat of an industrial fabric 130 according to the thirteenth embodiment. Compared to the industrial fabric 30 shown in FIG. 5, the industrial fabric 130 according to the thirteenth embodiment is different in that a pair formed by a first binding warp and a second binding warp is not adjacent to a pair formed by a third binding warp and an upper surface side collapsing yarn. This allows the bound parts to be dispersed so as to suppress the occurrence of marks.

In the industrial fabric 130, a pair formed by a first binding warp and a second binding warp and a pair formed by a third binding warp and an upper surface side collapsing yarn each form knuckles passing above two consecutive upper surface side wefts and form the same weaving pattern. On the other hand, since the upper surface side warps have a weaving pattern of being interwoven with the upper surface side wefts above and below the upper surface side warps one by one, the pair formed by the first binding warp and the second binding warp is different in the weaving pattern from the pair formed by the third binding warp and the upper surface side collapsing yarn.

Fourteenth Embodiment

Figure 20:
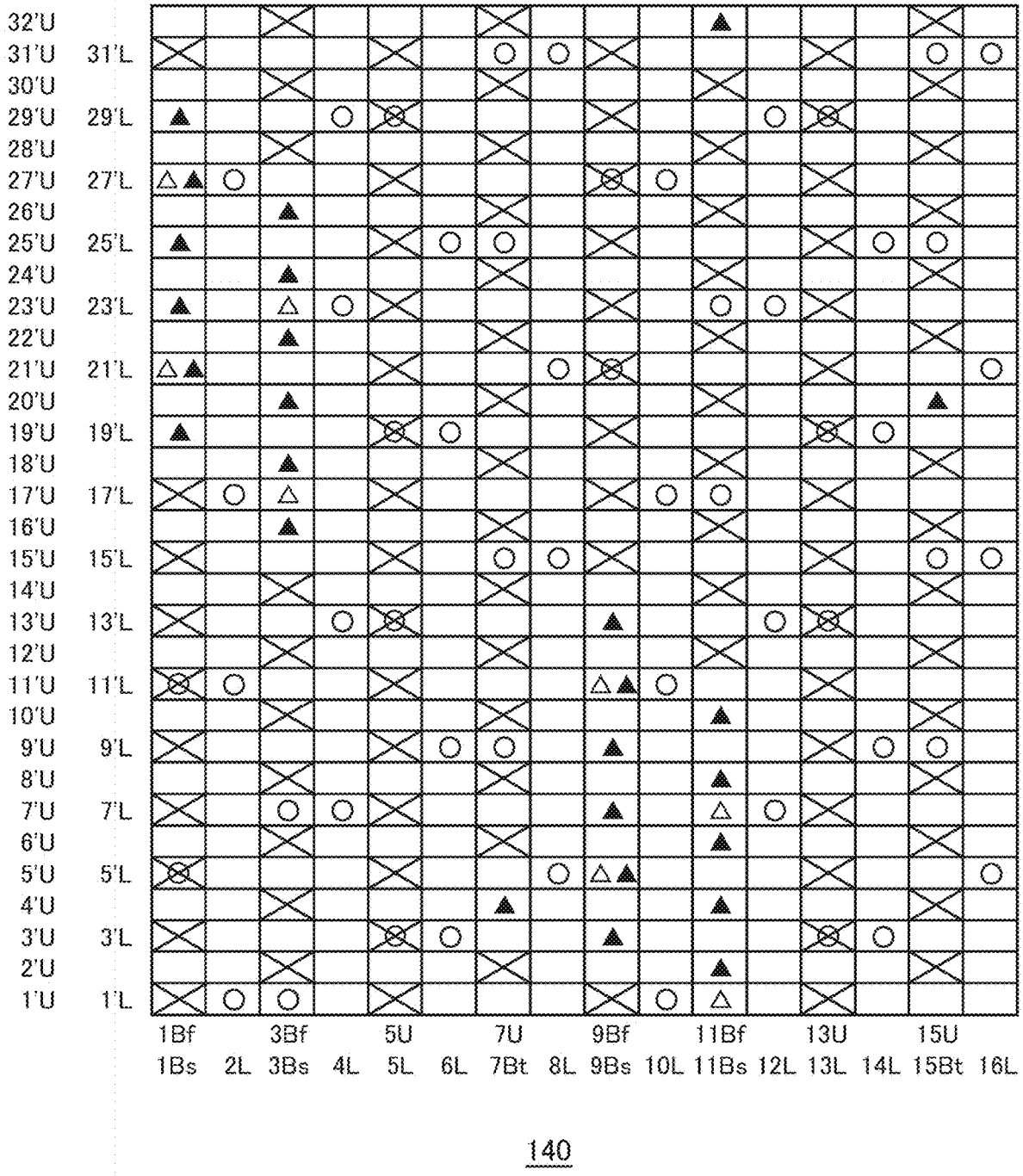
FIG. 20 is a design diagram showing a weave repeat of an industrial fabric according to the fourteenth embodiment.

FIG. 20 is a design diagram showing a weave repeat of an industrial fabric 140 according to the fourteenth embodiment. Compared to the industrial fabric 90 shown in FIG. 15, the industrial fabric 140 according to the fourteenth embodiment is different in that one pair formed by a first binding warp and a second binding warp is arranged with a lower surface side warp interposed therebetween and in that the industrial fabric 140 includes a pair of an upper surface side warp and a lower surface side warp that are not binding warps. Looking only at the upper surface fabric, the pair formed by the first binding warp and the second binding warp seems to be adjacent to each other since the pair formed by a first binding warp and a second binding warp is arranged with a lower surface side warp interposed therebetween.

Fifteenth Embodiment

Figure 21:
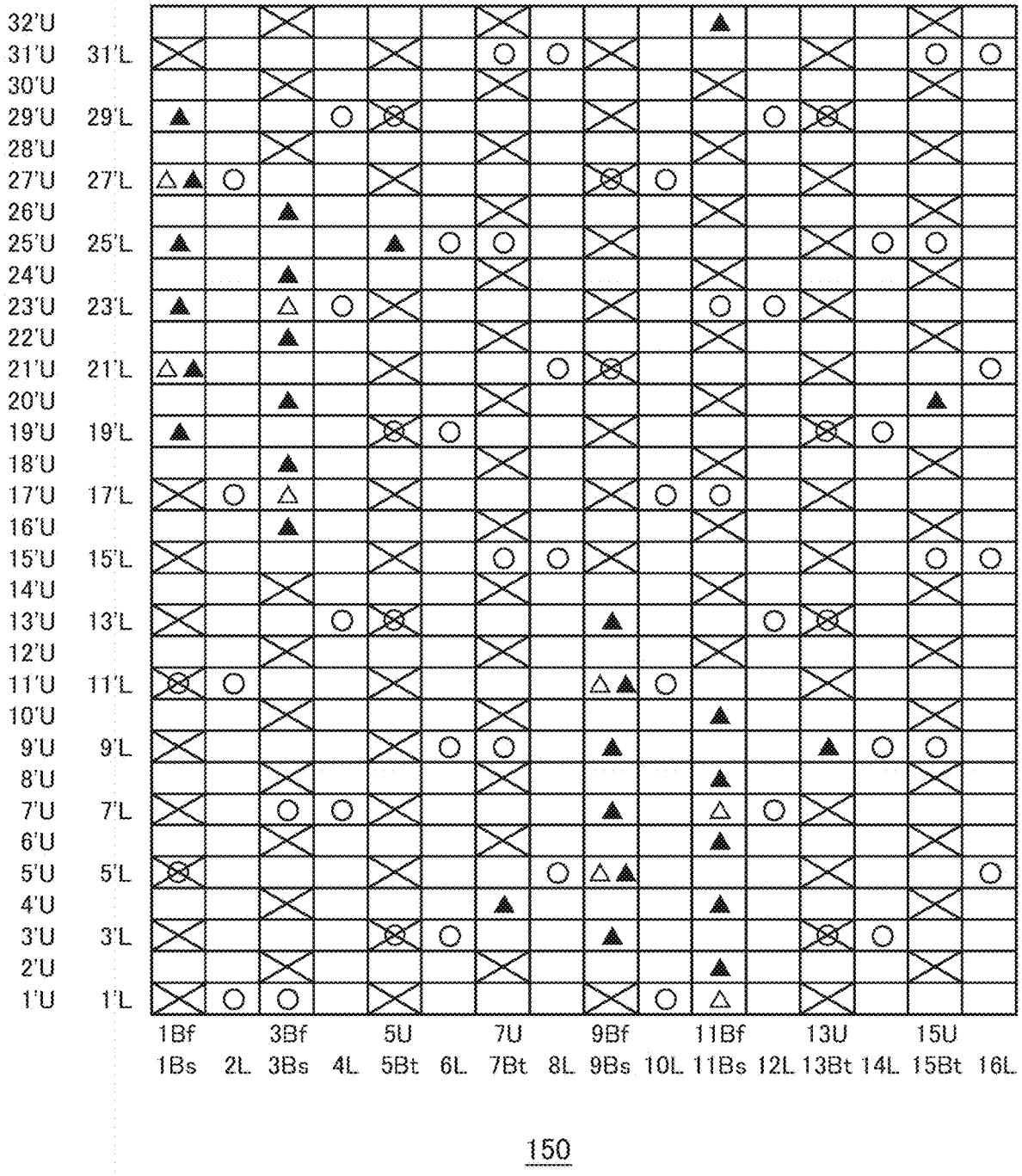
FIG. 21 is a design diagram showing a weave repeat of an industrial fabric according to the fifteenth embodiment.

FIG. 21 is a design diagram showing a weave repeat of an industrial fabric 150 according to the fifteenth embodiment. Compared to the industrial fabric 90 shown in FIG. 15, the industrial fabric 150 according to the fifteenth embodiment is different in that one pair formed by a first binding warp and a second binding warp is arranged with a lower surface side warp interposed therebetween and in that a pair of an upper surface side collapsing yarn and a third binding warp is arranged with a lower surface side warp interposed therebetween. Looking only at the upper surface fabric, the pair formed by the first binding warp and the second binding warp seems to be adjacent to each other, and the pair formed by the upper surface side collapsing yarn and the third binding warp seems to be adjacent to each other.

An industrial fabric according to each of the above embodiments may be subjected to the following processing. For example, in order to improve the surface smoothness, the obverse surface side of the industrial fabric may be polished in the range of 0.02 to 0.05 mm. In particular, the obverse surface side may be polished by 0.02 mm or 0.03 mm.

Further, in order to suppress the fraying of yarns at the ends of the mesh (industrial fabric), the range of 5 mm to 30 mm, particularly the range of 5 mm, 10 mm, or 20 mm, from the ends of the mesh may be coated with a polyurethane resin for reinforcement. The coating of the mesh ends may be coated on one or both sides. The resin may be hot melt polyurethane.

In order to improve the wear resistance of a mesh end, the mesh may be coated in the range of 20 mm to 500 mm, particularly 25, 50, 75, 100, 150, 250, 300, 350, or 400 mm, from the mesh end with three to sixteen, particularly three, four, seven, eight, ten, twelve, fifteen, or sixteen, strips of resin of a width of about 7 mm over the entire length. The plurality of above-mentioned strips of polyurethane resin may be applied to both ends of the mesh or only to one side. The resin may be hot melt polyurethane.

The entire mesh may be coated with resin in order to improve the antifouling performance. In order to allow for the trimming of the paper making width near the mesh end, the mesh may be coated in the range of 10 mm to 500 mm, particularly 10, 15, 20, 25, 30, 40, 50, 75, 100, 150, 200, 250, 300, 350, or 400 mm, from the mesh end with one strip of resin of a width of about 3, 5, 7, 10, 15, or 20 mm over the entire length. The above-mentioned resin may be applied to both ends of the mesh or only to one side. The resin may be polyurethane and may be hot melt. Further, the mesh may have lines of about 25 mm or 50 mm in width across the entire width so that the line bending of the mesh can be seen during use.

The following is a list of preferred element ranges for an industrial fabric. The warp diameter is preferably 0.10 mm to 1.0 mm, more preferably 0.1 mm to 0.5 mm, and particularly preferably 0.11 mm to 0.35 mm, where the warp includes an upper surface side warp, a lower surface side warp, a first binding warp, a second binding warp, and a third binding warp. The weft diameter is preferably 0.10 mm to 1.0 mm, more preferably 0.12 mm to 0.6 mm, and particularly preferably 0.12 mm to 0.55 mm.

The upper surface side wefts may be formed using only PET wires, only polyamide wires, or PET wires and polyamide wires that are alternately interwoven or may be formed using two consecutive PET wires and two consecutive polyamide wires that are alternately interwoven. The upper surface side wefts may be formed using only PET wires, only polyamide wires, or PET wires and polyamide wires that are alternately interwoven, may be formed using two consecutive PET wires and two consecutive polyamide wires that are alternately interwoven, or may be formed using PET wires and polyamide wires in the ratio of 1:2 or 1:3. Also, in order to reduce the driving load of the machine, low-friction yarns may be woven with the lower surface side wefts.

The ratio of the number of upper surface side wefts to the number of lower surface side wefts may be 1:1, 2:1, 3:1, 4:1, 3:2, 4:3, 5:2, 5:3, or 5:4. The air permeability is preferably 100 $cm^3/cm^2/s$ to 600 $cm^3/cm^2/s$ and more preferably 120 $cm^3/cm^2/s$ to 300 $cm^3/cm^2/s$.

The mesh thickness is preferably 0.3 mm to 3.0 mm, more preferably 0.5 mm to 2.5 mm, and particularly preferably 0.5 mm to 1.0 mm. The usage applications include mainly usage as a papermaking or nonwoven fabric belt and may include particularly usage as a papermaking dewatering belt or a spunbond nonwoven fabric conveying belt.

The cross-sectional shape of the warps and wefts according to each of the above-mentioned embodiments is not limited to a circular shape, and yarns having a quadrangular shape, a star shape, etc., and yarns having an elliptical shape, a hollow shape, a sheath-core structure shape, etc., can be used. In particular, by making the cross-sectional shape of the lower warps have a square shape, a rectangular shape, or an elliptical shape, the cross-sectional area of the yarns can be increased, and elongation resistance and rigidity can thus be improved.

Further, the yarn material can be freely selected as long as the yarn satisfies the desired characteristics, and polyethylene terephthalate, polyester, polyamide, polyphenylene sulfide, polyvinylidene fluoride, polypropylene, aramid, polyether ether ketone, polyethylene naphthalate, polytetrafluoroethylene, cotton, wool, metals, thermoplastic polyurethane, thermoplastic elastomers, etc., can be used. Needless to say, yarns prepared from a copolymer and yarns prepared by blending or adding various substances to such a material may be used according to the purpose. In general, polyester monofilaments having rigidity and excellent dimensional stability are preferably used as yarns constituting industrial fabrics.

The number of warp shafts is preferably 4, 8, 12, 16, 20, 24, 28, 32, or 36. Further, the number of weft shafts is preferably 8, 12, 16, 20, 24, 28, 32, 36, 40, 44, or 48.

The embodiments are intended to be illustrative only, and it will be obvious to those skilled in the art that various modifications to constituting elements could be developed and that such modifications are also within the scope of the present invention.

What is claimed is:

1. An industrial fabric in which an upper surface side fabric and a lower surface side fabric are bound, comprising:

upper surface side wefts that form a part of the upper surface side fabric;

lower surface side wefts that form a part of the lower surface side fabric;

upper surface side warps that are interwoven only with the upper surface side wefts so as to form a part of the upper surface side fabric;

lower surface side warps that are interwoven only with the lower surface side wefts so as to form a part of the lower surface side fabric; and binding warps that bind the upper surface side fabric and the lower surface side fabric, wherein the binding warps have:

a first binding warp and a second binding warp that are arranged vertically in a pair; and a third binding warp that forms knuckles passing above the upper surface side wefts, wherein the upper surface side warps include an upper surface side collapsing yarn that forms vertically a pair with the third binding warp, wherein the upper surface side collapsing yarn passes below the upper surface side wefts and collapses a part of the upper surface side obverse surface texture at a position where the third binding warp forms the knuckles on the upper surface side wefts, and wherein the pair formed by the first binding warp and the second binding warp complement each other while the pair formed by the third binding warp and the upper surface side collapsing yarn complement each other in a weave repeat.

2. The industrial fabric according to claim 1, wherein the pair formed by the first binding warp and the second binding warp and the pair formed by the third binding warp and the upper surface side collapsing yarn thereby form the same weaving pattern for the upper surface side wefts in a weave repeat.

3. The industrial fabric according to claim 1, wherein the number of the warps forming the weave repeat is a multiple of four.

4. The industrial fabric according to claim 1, wherein the pair formed by the first binding warp and the second binding warp is adjacent to the pair formed by the third binding warp and the upper surface side collapsing yarn.

5. The industrial fabric according to claim 1, wherein the pair formed by the first binding warp and the second binding warp is not adjacent to the pair formed by the third binding warp and the upper surface side collapsing yarn.

6. The industrial fabric according to claim 1, wherein the number of the first binding warp, the second binding warp, and the third binding warp combined is less than half the number of all the warps in the weave repeat.

7. The industrial fabric according to claim 1, wherein the number of the first binding warp, the second binding warp, and the third binding warp combined is half or more the number of all the warps in the weave repeat.

8. The industrial fabric according to claim 1, wherein the number of knuckles formed by the third binding warp passing above the upper surface side wefts is less than the number of knuckles formed by the first binding warp or the second binding warp passing above the upper surface side wefts.

9. The industrial fabric according to claim 1, wherein the pair formed by the first binding warp and the second binding warp complement each other while the pair formed by the third binding warp and the upper surface side collapsing yarn complement each other such that the pair formed by the first binding warp and the second binding warp and the pair formed by the third binding warp and the upper surface side collapsing yarn thereby form the same weaving pattern for the lower surface side wefts in a weave repeat.

* * * * *